US007780577B2

(12) United States Patent
Arnold

(10) Patent No.: US 7,780,577 B2
(45) Date of Patent: Aug. 24, 2010

(54) PENDULOUS EXERCISE DEVICE

(75) Inventor: Peter J. Arnold, Snohomish, WA (US)

(73) Assignee: Precor Incorporated, Chicago, IL (US)

( * ) Notice: Subject to any disclaimer, the term of this patent is extended or adjusted under 35 U.S.C. 154(b) by 521 days.

(21) Appl. No.: 11/487,212

(22) Filed: Jul. 14, 2006

(65) Prior Publication Data

US 2008/0020902 A1 Jan. 24, 2008

(51) Int. Cl.

| | |
|---|---|
| ***A63B 22/00*** | (2006.01) |
| ***A63B 71/00*** | (2006.01) |
| ***A63B 22/04*** | (2006.01) |
| ***A47D 13/04*** | (2006.01) |

(52) U.S. Cl. ..... 482/51; 482/52; 482/69

(58) Field of Classification Search ..... 482/151, 482/51, 52, 62, 63, 70, 96

See application file for complete search history.

(56) References Cited

U.S. PATENT DOCUMENTS

| | | | | | |
|---|---|---|---|---|---|
| 3,475,021 | A | * | 10/1969 | Ruegsegger | 482/71 |
| 3,912,260 | A | | 10/1975 | Rice | 272/57 B |
| 4,869,496 | A | * | 9/1989 | Colombo | 482/71 |
| 5,284,460 | A | * | 2/1994 | Miller et al. | 482/51 |
| 5,378,209 | A | * | 1/1995 | Kendrew | 482/52 |
| 5,496,235 | A | | 3/1996 | Stevens | 482/51 |
| 5,496,239 | A | * | 3/1996 | Kallman et al. | 482/71 |
| 5,536,225 | A | * | 7/1996 | Neuberg et al. | 482/71 |
| 5,575,739 | A | * | 11/1996 | Piaget et al. | 482/51 |
| 5,577,985 | A | | 11/1996 | Miller | 482/52 |
| 5,584,781 | A | | 12/1996 | Chen | 482/51 |
| 5,595,553 | A | | 1/1997 | Rodgers, Jr. | 482/51 |
| 5,595,554 | A | * | 1/1997 | Maresh | 482/52 |
| 5,690,593 | A | * | 11/1997 | Huang | 482/96 |
| 5,718,658 | A | * | 2/1998 | Miller et al. | 482/71 |
| 5,749,811 | A | * | 5/1998 | Wilson | 482/71 |
| 5,792,027 | A | | 8/1998 | Gvoich | 482/51 |
| 5,792,028 | A | | 8/1998 | Jarvie | |
| 5,795,268 | A | | 8/1998 | Husted | 482/51 |
| 5,857,940 | A | * | 1/1999 | Husted | 482/51 |
| 5,910,072 | A | * | 6/1999 | Rawls et al. | 482/51 |
| 5,957,814 | A | | 9/1999 | Eschenbach | 482/51 |
| 6,036,622 | A | * | 3/2000 | Gordon | 482/51 |

(Continued)

FOREIGN PATENT DOCUMENTS

| | | |
|---|---|---|
| WO | WO 99/28001 | 6/1999 |

(Continued)

OTHER PUBLICATIONS

Ball and socket joint definition attached.*

*Primary Examiner*—Steve R Crow
*Assistant Examiner*—Robert F Long
(74) *Attorney, Agent, or Firm*—Terence P. O'Brien; Todd A. Rathe; Paul E. Schaafsma

(57) ABSTRACT

In accordance with the principles of the present invention, a pendulous exercise device is provided that comprises first and second swing arms pivotally coupled to a frame. The first and second swing arms extend from the frame at an angle from vertical. First and second footpads are provided pivotally coupled to the first and second swing arms, respectively. Each footpad defines a footpath comprising a forward/rearward component, an upward/downward component and an inward/outward component.

56 Claims, 20 Drawing Sheets

U.S. PATENT DOCUMENTS

| | | | | |
|---|---|---|---|---|
| 6,042,510 | A * | 3/2000 | Miller | 482/51 |
| 6,117,052 | A | 9/2000 | Frost et al. | 482/52 |
| 6,120,416 | A | 9/2000 | Walker | 485/57 |
| 6,126,573 | A | 10/2000 | Eschenbach | 482/51 |
| 6,132,339 | A * | 10/2000 | Wang et al. | 482/53 |
| 6,220,990 | B1 * | 4/2001 | Crivello | 482/51 |
| 6,231,484 | B1 * | 5/2001 | Gordon | 482/71 |
| 6,278,044 | B1 | 8/2001 | Ruan | 482/52 |
| 6,390,953 | B1 * | 5/2002 | Maresh et al. | 482/52 |
| 6,461,277 | B2 | 10/2002 | Maresh et al. | 482/52 |
| 6,514,180 | B1 * | 2/2003 | Rawls | 482/70 |
| 6,551,218 | B2 | 4/2003 | Goh | 482/52 |
| 6,761,665 | B2 | 7/2004 | Nguyen | 482/51 |
| 7,014,595 | B2 * | 3/2006 | Bruno | 482/51 |
| 7,115,073 | B2 * | 10/2006 | Nizamuddin | 482/51 |
| 7,261,675 | B2 * | 8/2007 | Kuo | 482/52 |
| 7,270,625 | B2 * | 9/2007 | Miller | 482/52 |
| 7,384,381 | B2 * | 6/2008 | Webber et al. | 482/100 |
| 7,425,189 | B1 * | 9/2008 | Eschenbach | 482/52 |
| 7,479,093 | B1 * | 1/2009 | Immordino et al. | 482/52 |
| 7,563,214 | B2 * | 7/2009 | Webber et al. | 482/135 |
| 2002/0019298 | A1 | 2/2002 | Eschenbach | 482/51 |
| 2002/0119871 | A1 * | 8/2002 | Fulks | 482/93 |
| 2003/0092532 | A1 | 5/2003 | Giannelli et al. | 482/51 |
| 2004/0097335 | A1 * | 5/2004 | Chu | 482/51 |
| 2004/0192508 | A1 * | 9/2004 | Lanoue | 482/51 |
| 2004/0224825 | A1 | 11/2004 | Giannelli et al. | 482/52 |
| 2004/0266587 | A1 | 12/2004 | Miller | 482/52 |
| 2005/0026752 | A1 | 2/2005 | Lull et al. | 482/57 |
| 2005/0049116 | A1 * | 3/2005 | Huang | 482/51 |
| 2005/0054488 | A1 * | 3/2005 | Husted et al. | 482/51 |
| 2005/0079958 | A1 | 4/2005 | Stearns | 482/52 |
| 2005/0107224 | A1 * | 5/2005 | Akhmetov | 482/95 |
| 2005/0124466 | A1 * | 6/2005 | Rodgers | 482/52 |
| 2005/0245357 | A1 * | 11/2005 | Horvath | 482/51 |
| 2006/0223678 | A1 * | 10/2006 | MacLean | 482/51 |
| 2006/0293153 | A1 * | 12/2006 | Porth et al. | 482/52 |
| 2007/0027001 | A1 * | 2/2007 | Alessandri et al. | 482/51 |
| 2007/0037667 | A1 * | 2/2007 | Gordon | 482/51 |
| 2007/0179023 | A1 * | 8/2007 | Dyer | 482/52 |
| 2007/0202994 | A1 * | 8/2007 | Alessandri et al. | 482/51 |
| 2007/0232457 | A1 * | 10/2007 | Porth | 482/51 |
| 2008/0032866 | A1 * | 2/2008 | Chang | 482/51 |
| 2008/0132385 | A1 * | 6/2008 | Alessandri et al. | 482/52 |
| 2008/0167164 | A1 * | 7/2008 | Wang | 482/52 |
| 2010/0093497 | A1 * | 4/2010 | Kuo | 482/52 |

FOREIGN PATENT DOCUMENTS

| | | |
|---|---|---|
| WO | WO 99/39779 | 8/1999 |
| WO | WO 2005/107889 | 11/2005 |

* cited by examiner

PENDULOUS EXERCISE DEVICE

FIELD OF THE INVENTION

The present invention relates to exercise equipment.

BACKGROUND OF THE INVENTION

The benefits of regular exercise have been well established and accepted. However, due to time constraints, inclement weather, and other reasons, many people are prevented from activities such as participating in sports, walking, jogging, running, and swimming. As a result, a variety of exercise equipment has been developed. It is generally desirable to exercise a large number of different muscles over a large range of motion so as to provide for balanced physical development, and to achieve optimum levels of exercise. It is further advantageous for exercise equipment to provide smooth and natural motion, thus avoiding significant jarring and strain that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing exercise devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised.

Treadmills are still a further type of exercise device in the prior art. Treadmills allow natural walking or jogging motions; however, treadmills can enable significant impact loads to be transferred to the hips, knees, ankles, and other joints of a user, particularly when the treadmill is used to simulate running or jogging.

Another type of exercise device simulates stair climbing. Such devices can be composed of foot levers that are pivotally mounted to a frame at their forward ends and have foot-receiving pads at their rearward ends. A user pushes his/her feet down against the foot levers to simulate stair climbing. Resistance to the downward movement of the foot levers is provided by springs, fluid shock absorbers and/or other elements. These devices exercise more muscles than stationary bicycles; however, the rather limited range of up-and-down motion utilized does not exercise the leg muscles of a user through a large range of motion. The substantially vertical reciprocating motion of such stair climbing exercise machines can result in substantial impact loads being applied to the hips, knees, ankles and other joints of a user. Further, the up-and-down reciprocating motion can induce a hyperextension of the knee of a user.

A relatively new class of exercise devices is capable of producing elliptical motion that better simulates the natural stride of a person. Elliptical motion is much more natural and analogous to running, jogging, and walking than the linear-type, back and forth motions produced by some prior art exercise equipment. However, some users find the repetitive elliptical motion occurring about a generally fixed plane to be routine and not stimulating.

One drawback of all these exercise devices is that they do not generally replicate one of the natural human motions employed in many athletic endeavors. In particular, they do not replicate a motion having a forward/rearward component, an upward/down ward component, and a side-to-side component. Stationary bicycles, cross-country skiing simulators, stair climbers, treadmills, and even elliptical devices all utilize a strict front-to-back or striding type motion. What would thus be advantageous would be an exercise device that emulates a natural human movement that includes not only front-to-back motion but also side-to-side and up-and-down motions.

In the prior art, various attempts have been made to utilize the use of side-to-side motion instead of a front-to-back walking or striding type motion. In contrast to the aforementioned cross-country skiing simulator that utilizes a striding motion, various devices attempt to simulate the experience of downhill skiing. While these devices do incorporate some limited side-to-side motion, these devices have not been met with general commercial approval as not offering a high level downhill skiing simulation while being unyielding and cumbersome to use. Some attempts to utilize side-to-side motion instead of a front-to-back walking or striding type motion have overcompensated and are limited to strict side-to-side motion; these, however, do no better in simulating the actual human experience of such exercise activates as downhill skiing, ice-skating, in-line roller skating, etc.

Further, many of prior art devices, in particular stationary bicycles, stair climbers and treadmills, do not provide a total body exercise incorporating the upper body of a user. Accordingly, such prior art devices provide a user with the ability to exercise and develop his or her upper body muscles.

Accordingly, a continuing need exists for an exercise device that provides a natural fluid exercise motion incorporating side-to-side, up-and-down, and front and back movement with a user-defined stride length. There is also a need for an exercise device that enables a user to exercise muscles in a smooth natural manner over a large range of motion, without applying undesirable impact loads to the joints of a user. It would be desirable for such an exercise device to be configured for convenient use in a relatively confined space even in inclement weather. It would also be desirable to provide an exercise device incorporating this unique natural three directional movement in combination with an upper body exercise assembly to provide a complete total body exercise device. Further, a continuing need also exists for an exercise device that provides a unique engaging motion and is fun to use.

SUMMARY OF THE INVENTION

An exercise device in accordance with the principles of the present invention provides a side-to-side, up-and-down, and front-to-back movement with a user-defined stride length. An exercise device in accordance with the principles of the present invention exercise muscles in a smooth natural manner, without applying undesirable impact loads to the joints of a user. An exercise device in accordance with the principles of the present invention can be conveniently used in a relatively confined space even in inclement weather. An exercise device in accordance with the principles of the present invention incorporates a unique natural three directional movement in combination with an upper body exercise assembly to provide a complete total body exercise device. An exercise device in accordance with the principles of the present invention provides a unique engaging motion and is fun to use.

In accordance with the principles of the present invention, a pendulous exercise device is provided that comprises first and second swing arms pivotally coupled to a frame. The first and second swing arms extend from the frame at an angle from vertical. First and second footpads are provided pivotally coupled to the first and second swing arms, respectively.

The exercise device defines a footpath for each footpad. The footpath includes a forward/rearward component, an upward/downward component and an inward/outward component.

This invention will become more fully understood from the following detailed description, taken in conjunction with the accompanying drawings described herein below, and wherein like reference numerals refer to like parts.

DETAILED DESCRIPTION OF A PREFERRED EMBODIMENT

Figure 1:
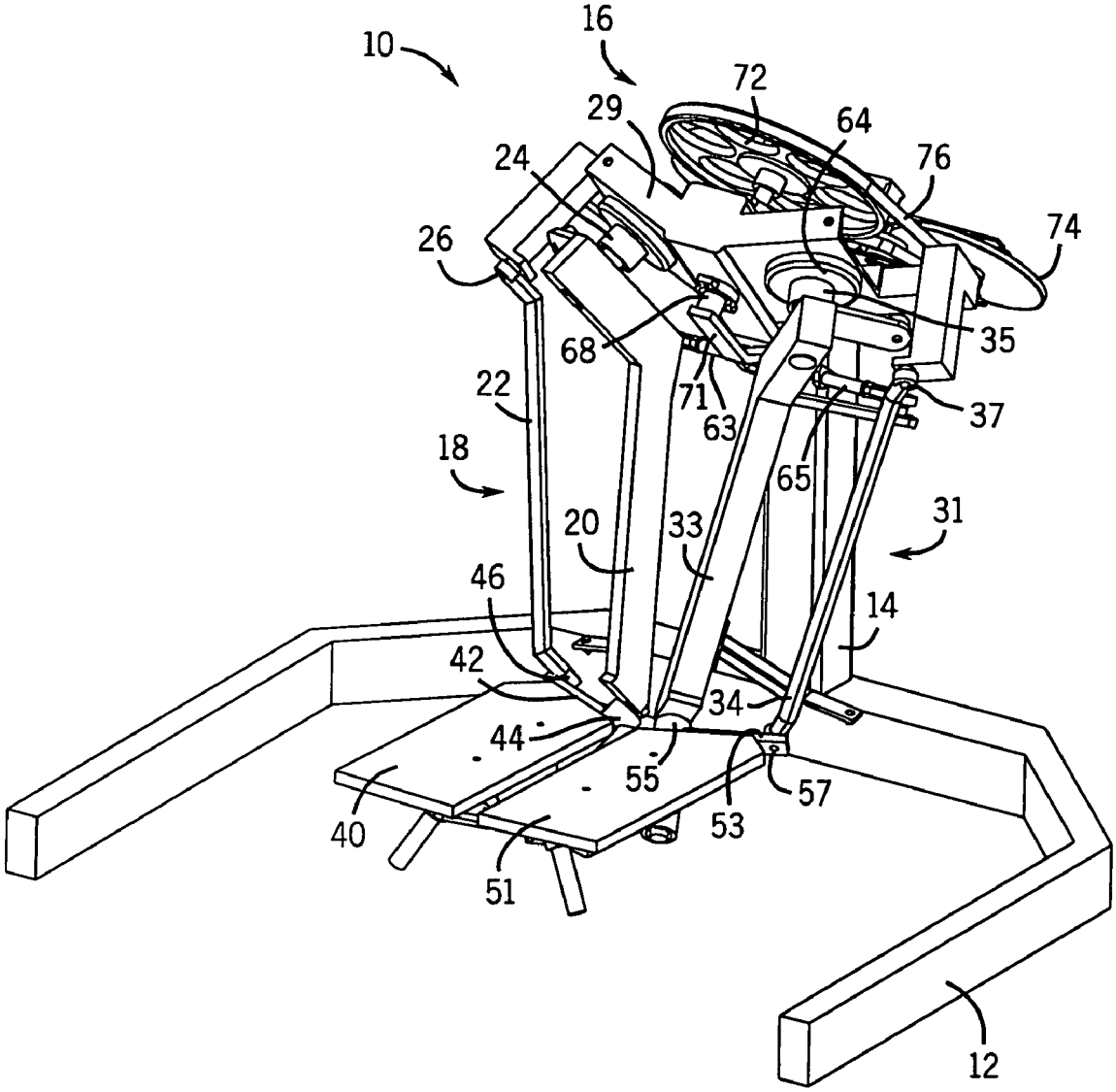
FIG. 1 is a front perspective view of an exercise device in accordance with the principles of the present invention.

Referring to FIGS. 1-5, an initial embodiment of an exercise device in accordance with the principles of the present invention is seen. The exercise device 10 of the present invention can include a base 12 that provides structural support for the exercise device 10 on a floor. A support frame 14 can be provided extending upwardly from the base 12. The support frame 14 supports a swing assembly 16 as described in more detail below. For esthetics, the swing assembly 16 can be covered by a shroud (not seen). To use the exercise device 10, a user stands on a pair of footpads 40, 51 supported by the swing assembly 16. As described in detail below, when in use the exercise device 10 emulates a natural human movement that includes not only front-to-back or striding type motion but also side-to-side and up-and-down motion.

The swing assembly 16 includes a first pendulum assembly 18 and second pendulum assembly 31. Each of the first pendulum assembly 18 and the second pendulum assembly 31 are configured to swing in a front-to-back, side-to-side and up-and-down motion, as described in detail below. The first pendulum assembly 18 includes a first swing arm 20 and a first follower arm 22; likewise, the second pendulum assembly 31 includes a second swing arm 33 and a second follower arm 34. The top of the first swing arm 20 and the second swing arm 33 can be attached to a first swing arm pivot 24 and a second swing arm pivot 35, respectively, and positioned on a transverse support member 29 of the frame 14. The top of the first follower arm 22 and the second follower arm 37 can be attached to a first follower arm pivot 26 and a second follower arm pivot 37, respectively, also positioned on the transverse support member 29. In accordance with the principles of the present invention, by varying the orientation of these pivots the swinging motion of the exercise device can be varied, as described in detail below.

While the exercise device 10 described herein utilizes a linkage assembly as the cross-coupling assembly to coordinate the motion of the first and second pendulum assemblies, various alternative mechanical arrangements for the cross-coupling assembly may be employed such as, for example, a sprocket assembly, a pulley system, a cam system, or an electro-mechanical system. In addition, the present invention can include a load application system such as, for example, an eddy current brake assembly for selectively applying a braking or retarding force on the motion of the first and second pendulum assemblies 18 and 31. Alternative load application systems for applying braking or retarding forces to the first and second pendulum assemblies can be used, such as, for example, eddy current brake assembly, friction brakes, fluid resistance, or an alternator/generator. Still further, the four-bar linkage formed by the first pendulum assembly 18 and the second pendulum assembly 31 can take alternate configurations. For example, each of follower arms can extend upward from its respective footpad to only a portion of the length of its respective swing arm. Then, a crosslink member can be used to link the upward end of the follower arm to the swing arm at a predetermined location between the ends of the swing arm. Other configurations such as for example a single link with an upper and lower gear (sprocket or pulley) and a chain (or belt or rope) extending around each gear can serve as a pendulum assembly in accordance with the present invention.

The first pendulum assembly 18 supports the first footpad 40; likewise, the second pendulum assembly 31 supports the second footpad 51. The first footpad 40 and the second footpad 51 are coupled to a first footpad support 42 and a second footpad support 53, respectively. In an alternative embodiment, a pendulum type support can be used to support the footpad 40. The bottoms of the first swing arm 20 and the first follower arm 22 can be attached to the footpad support 42 by a first swing arm foot pivot 44 and a first follower arm foot pivot 46; likewise, the bottoms of the second swing arm 33 and the second follower arm 34 can be attached to the second footpad support 53 by a second swing arm foot pivot 55 and a second follower arm foot pivot 57. In one embodiment, the footpads 40, 51 can be made to facilitate the stability of a user while on the exercise device 10 by for example comprising a frictional material such as rubber defining a frictional surface such as for example ridges thereon. Other footpad configurations can also be used.

Figure 2:
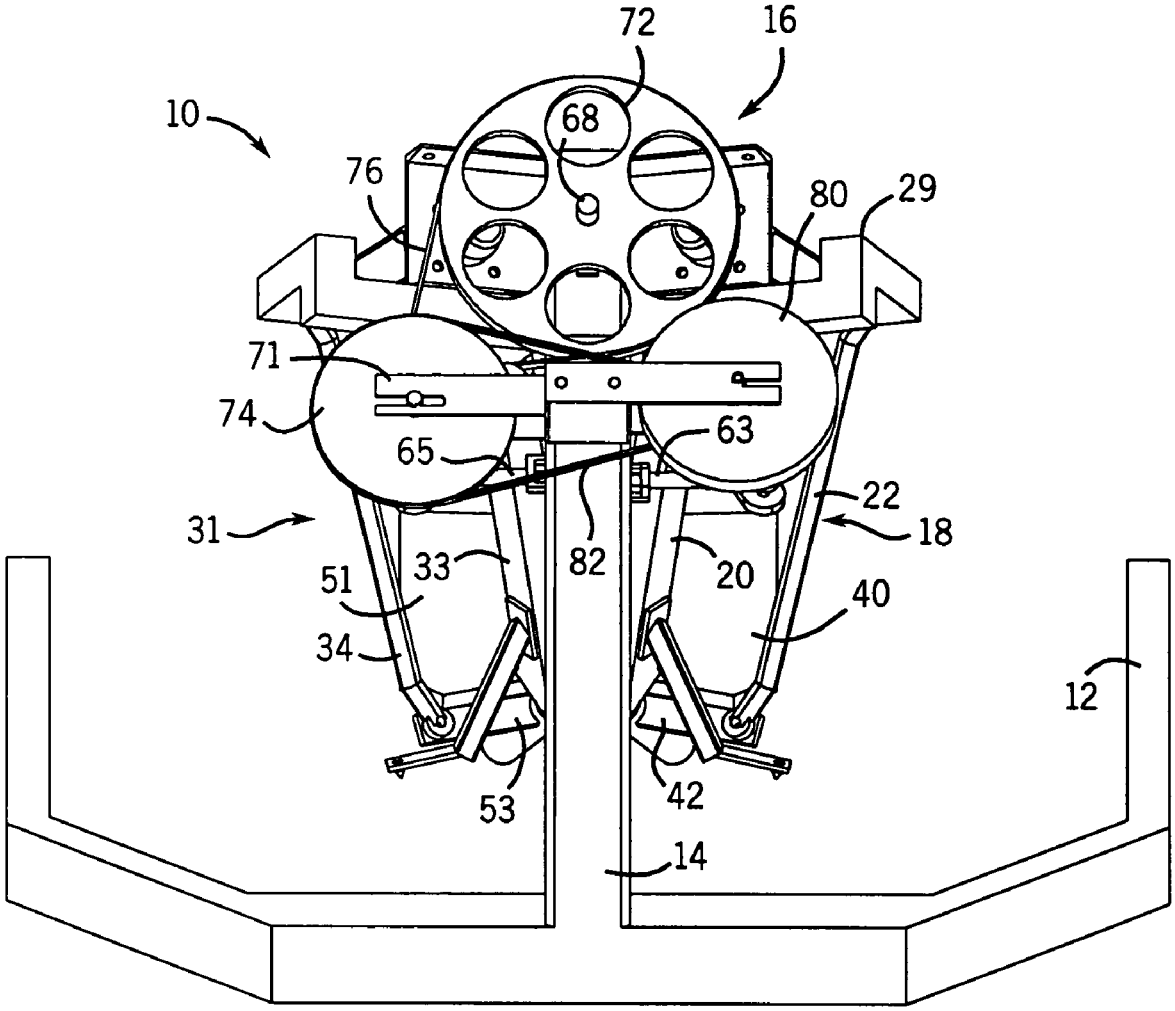
FIG. 2 is a raised rear view of the exercise device of FIG. 1.
Figure 3:
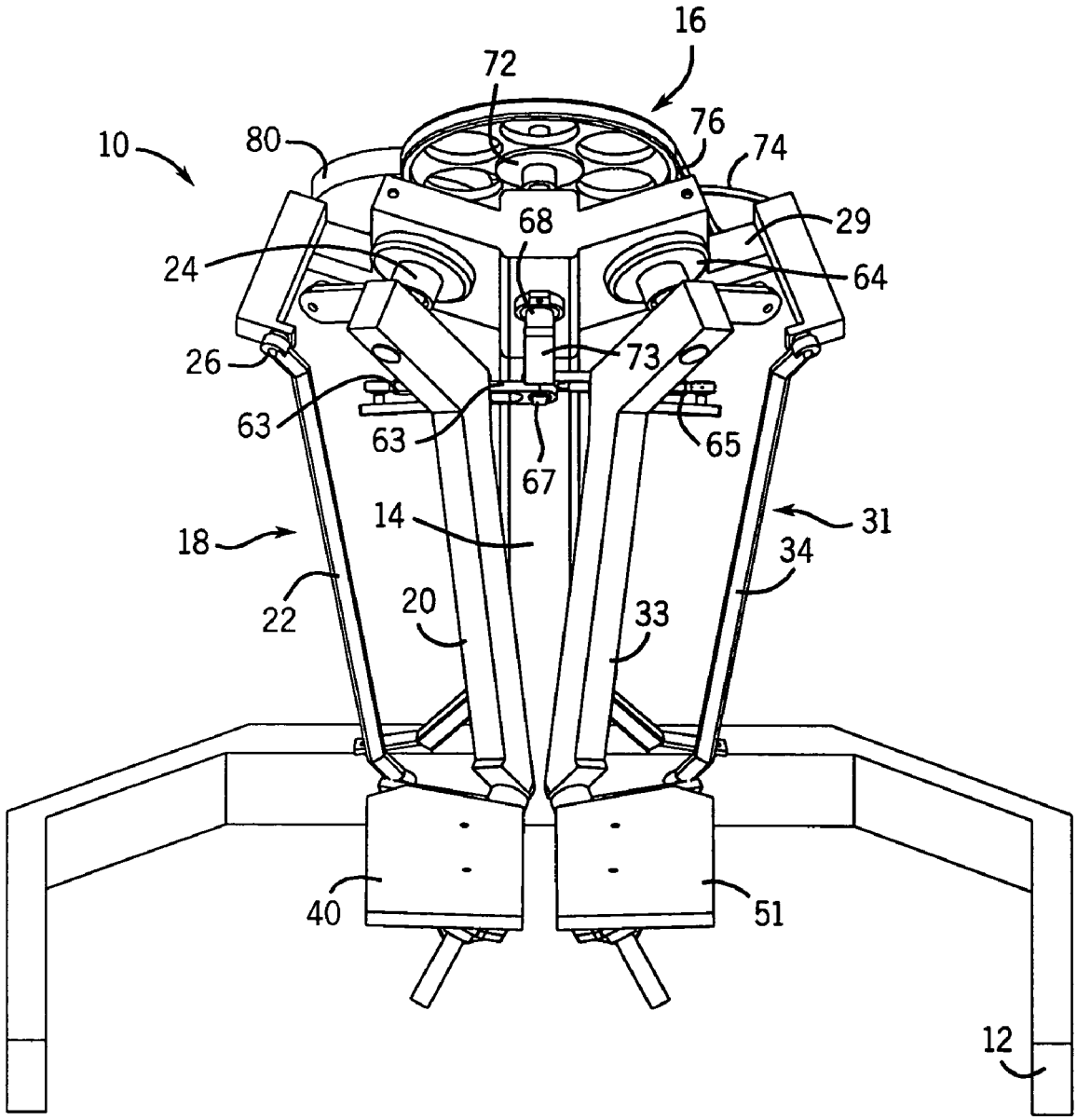
FIG. 3 is a raised front view of the exercise device of FIG. 1.

The motion of the first pendulum assembly 18 and the second pendulum assembly 31 can be coordinated and/or synchronized by use of a cross-coupling assembly, best seen in FIGS. 2 and 3. The first swing arm 20 and the second swing arm 33 are rotatably connected to a first center pivot link 63 and a second center pivot link 65 respectively. The first center pivot link 63 and the second center pivot link 65 are rotatably connected to a center pivot 67 (best seen in FIG. 3). The center pivot 67 is connected to the shaft 68 of a flywheel 72 by a resistance arm 71. The flywheel 72 smoothes the motion of the exercise device. The shaft 68 of the flywheel 72 can be anti-frictionally mounted by a bearing assembly in the transverse support member 29 of the frame 14.

The flywheel 72 can be connected to a smaller driven sheave on an axle 73 of a step-up pulley 74 via a belt 76 (best seen in FIG. 2). The axle 73 can be anti-frictionally mounted to the transverse support member 29 by a bearing assembly. A load applicator can be provided, such as, for example, an inertial weighted load applicator 80 driven via a belt 82. Thus, the flywheel 72 in combination with the step-up pulley 74 and the load applicator provide inertia to the movements of the footpads 40, 51.

The alternator/generator can be used to provide resistance or braking to the exercise device as well as to generate power for use by system electronics. A resistance control can be provided that controls the load application system. The resistance can be transmitted to a central processing unit (CPU) provided with the exercise device through an analog to digital interface and controller. In one embodiment, a speed control can be provided.

It may be desirable to monitor the speed of the motion of the first and second pendulum assemblies 18 and 31 so as to measure the strides or strokes traveled, the work performed, the calories burned, etc. by a user of the exercise device. It may also be desirable to control the level of workout experienced by a user. Any standard method of measuring speed may be utilized. For instance, an optical or magnetic strobe wheel may be mounted onto a rotating or moving disk or member of the present device. The speed of the strobe wheel may be monitored by an optical or magnetic sensor to generate an electrical signal related to such rotational speed. The speed can be transmitted to a CPU through an analog to digital interface and controller.

To use the present invention a user stands on the footpads 40, 51, preferably facing away from the pendulum assemblies 18, 31, with the footpads 40 and 51 in a neutral centered position. Alternatively, the user can face towards the pendulum assemblies 18. A user can shift his or her weight to one side thereby imparting a downward force on one footpad, while reducing force on the other footpad, thereby causing the footpad on which the force is exerted to swing downward, rearward and outward while the footpad on which force is reduced swings upward, forward and inward. Importantly, the shifting of the weight of a user contributes to the motion of the exercise device. Further, the stroke or stride length of the exercise device is user defined, thereby increasing the flexibility and versatility of the exercise device.

Upon achieving the desired swing motion, a user alternates the force imparted on the footpads 40, 51, thus imparting a downward force on the footpad on which force had previously been reduced while reducing force on the footpad on which force had previously been exerted. This opposes the inertial momentum of the swing assembly 16, causing the first pendulum assembly 18 and the second pendulum assembly 31 to reverse. This process can be repeated causing the first pendulum assembly 18 and the second pendulum assembly 31 to swing from side-to-side, forward and rearward, and up-and-down.

Figure 4:
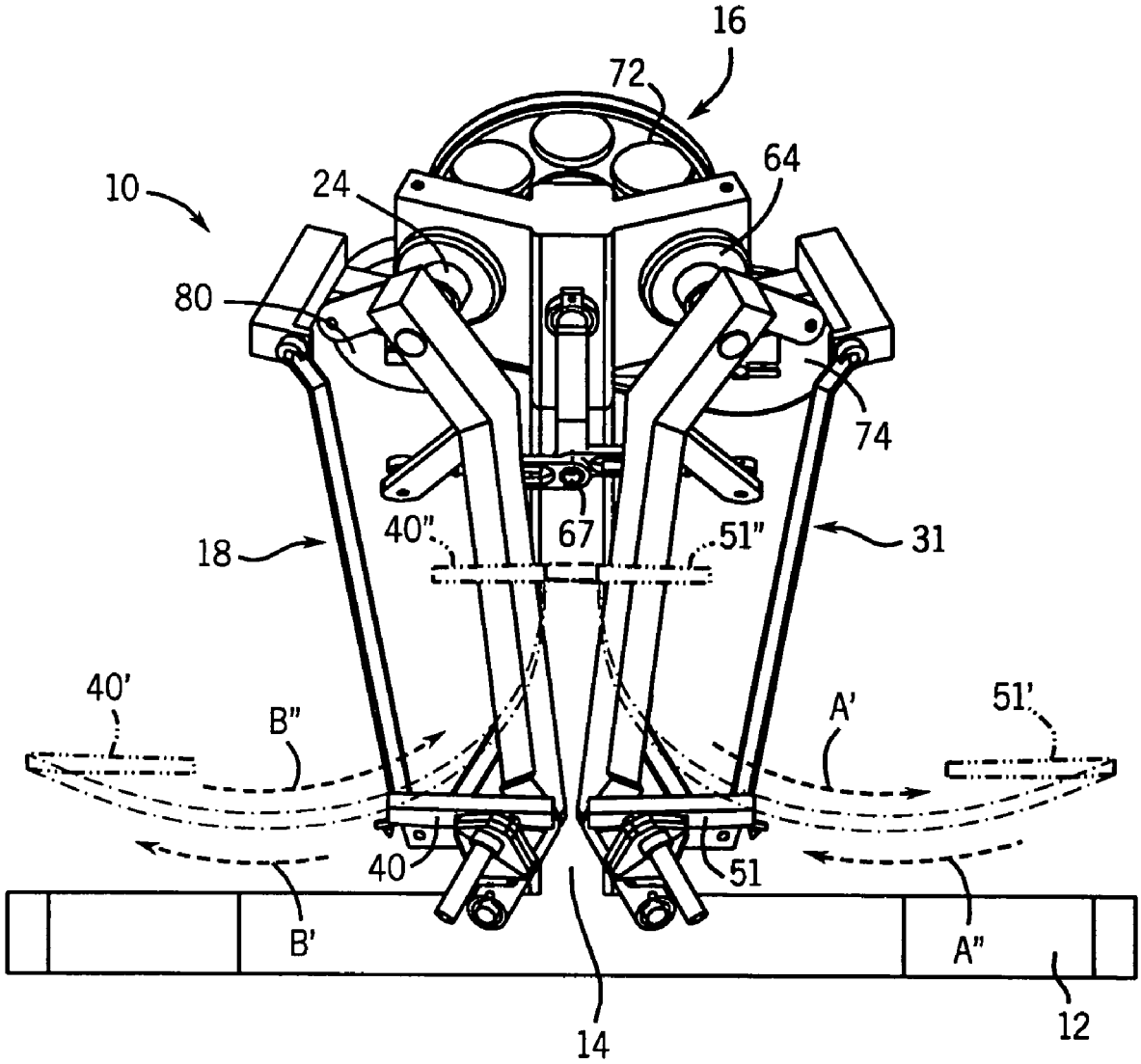
FIG. 4 is an elevated frontal view the swing path of the footpads of the exercise device of FIG. 1.
Figure 5:
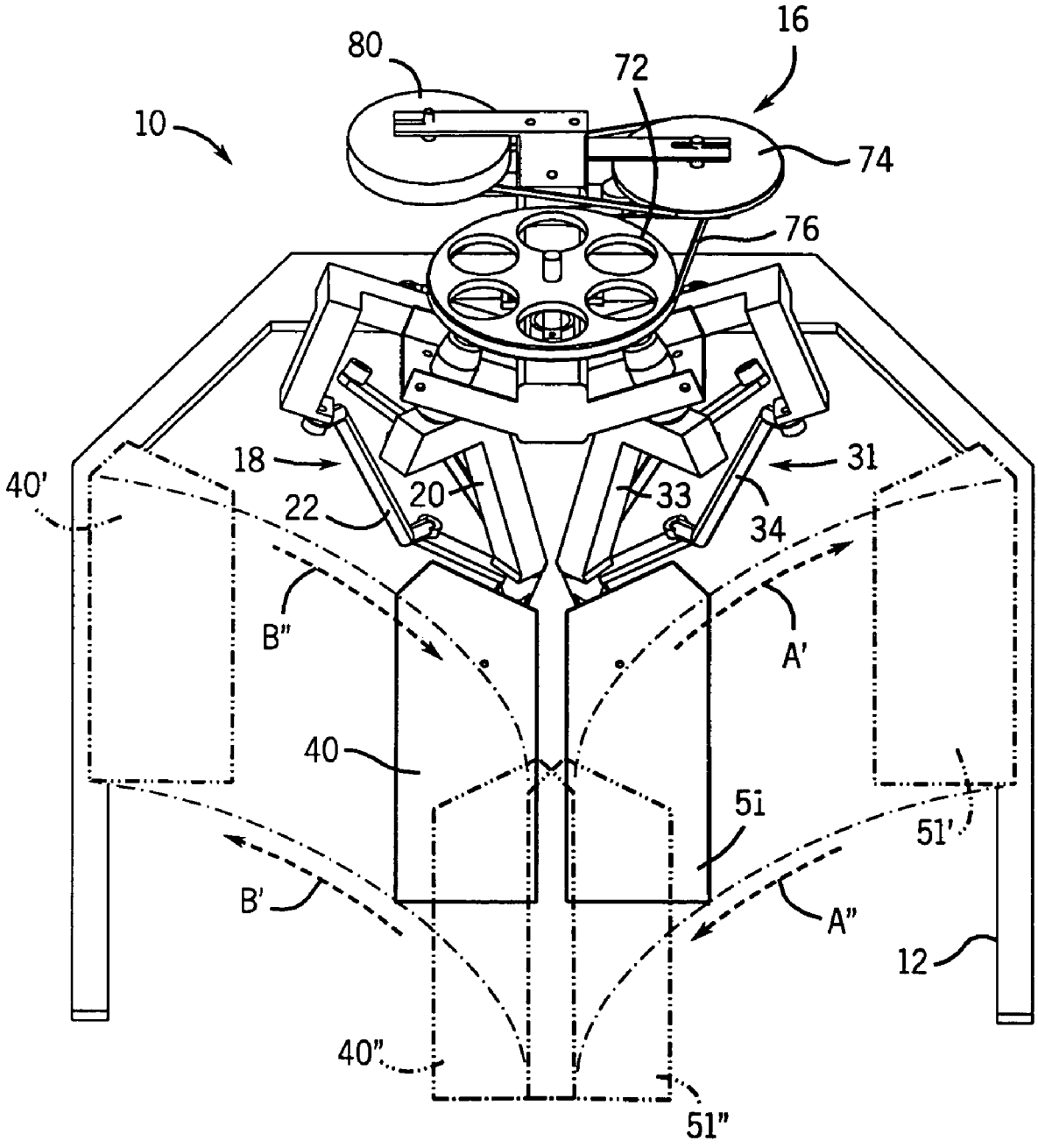
FIG. 5 is an overhead view the swing path of the footpads of the exercise device of FIG. 1.

Referring to FIGS. 4 and 5, the swing path of the footpads 40, 51 can be seen in phantom, with FIG. 4 an elevated front view and FIG. 5 an overhead view. The footpads 40 and 51 are shown in solid in a neutral centered position. When a user imparts downward force on one footpad 51 while reducing force on the other footpad 40, the footpad 51 swings downward, rearward and outward in a path A' towards the position depicted in phantom as footpad 51' while footpad 40 swings upward, forward and inward in a path B" towards the position depicted in phantom as footpad 40". When a user imparts downward force on footpad 40 while reducing force on the footpad 51, the footpad 40 swings downward, rearward and outward in a path B' towards the position depicted in phantom as footpad 40'while footpad 51 swings upward, forward and inward in a path A" towards the position depicted in phantom as footpad 51". Thus, an exercise device in accordance with the principles of the present invention imparts a natural human movement that includes not only front-to-back or striding type motion but also side-to-side and up-and-down motion can be seen in FIGS. 4 and 5

Figure 6:
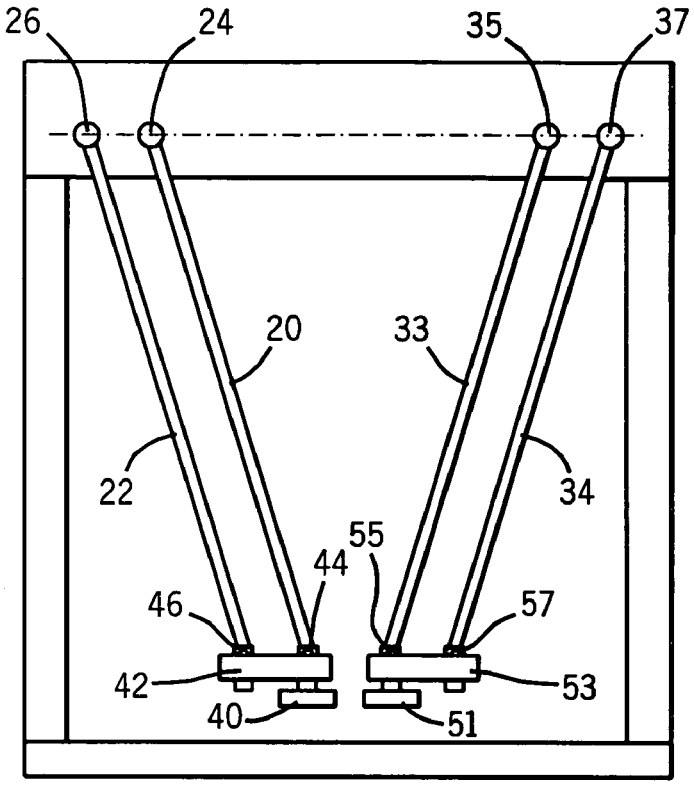
FIG. 6 shows a front, elevational schematic of one embodiment of an exercise device in accordance with the principles of the present invention.
Figure 7:
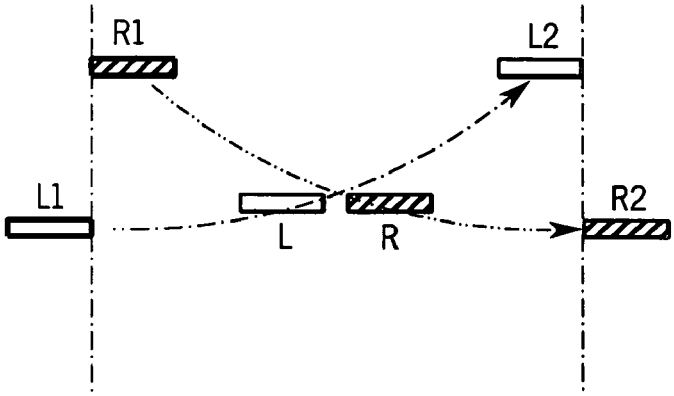
FIG. 7 shows a front, elevational schematic of the footpads of the embodiment of FIG. 6.
Figure 8:
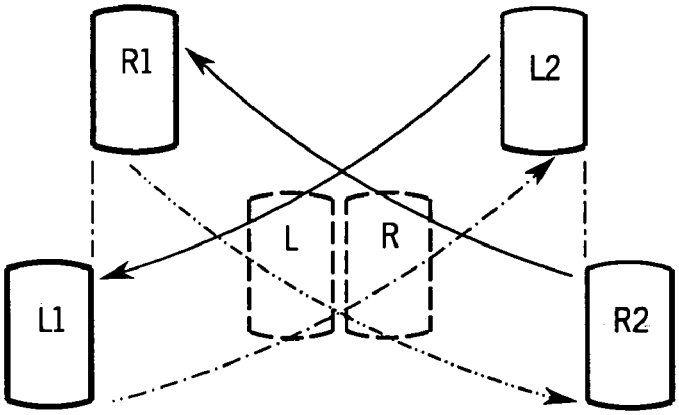
FIG. 8 shows an overhead schematic of the footpads of the embodiment of FIG. 6.
Figure 9:
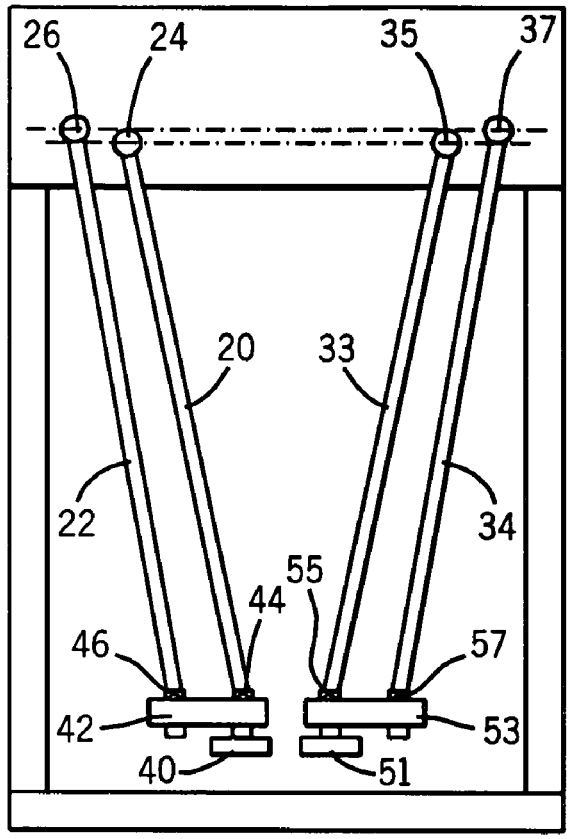
FIG. 9 shows a front, elevational schematic of an additional embodiment of an exercise device in accordance with the principles of the present invention.

In addition, as previously referenced in accordance with the principles of the present invention the path of the footpads can be varied by varying the orientation of various structural elements. Referring now to FIGS. 6-8, FIG. 6 shows a front, elevational schematic of an exercise device in accordance with the principles of the present invention (with the cross-coupling assembly removed for ease of reference), FIG. 7 shows a rear, elevational schematic of the footpads of this embodiment while FIG. 8 shows an overhead schematic of the footpads.

In the embodiment depicted in FIGS. 6-8, the first swing arm pivot 24, the second swing arm pivot 35, the first follower arm pivot 26, and the second follower arm pivot 37 are in-line. In addition, the distance between the first swing arm pivot 24 and the first follower arm pivot 26 is the same as the distance between the second swing arm foot pivot 26 and the second follower arm pivot 37; which are likewise the same as the distance between the first swing arm foot pivot 44 and the first follower arm foot pivot 46; which is likewise the same as the distance between the second swing arm foot pivot 55 and the second follower arm foot pivot 57. Further, the lengths of the first and second swing arms 20 and 33, and the first and second follower arms 22 and 34, are the same. Thus, in this embodiment, the four-bar linkage results in the footpads maintaining a generally parallel position relative to horizontal (seen in FIG. 7) as the footpads 40 and 51 turn to remain generally parallel during the swinging motion (seen in FIG. 8).

Figure 10:
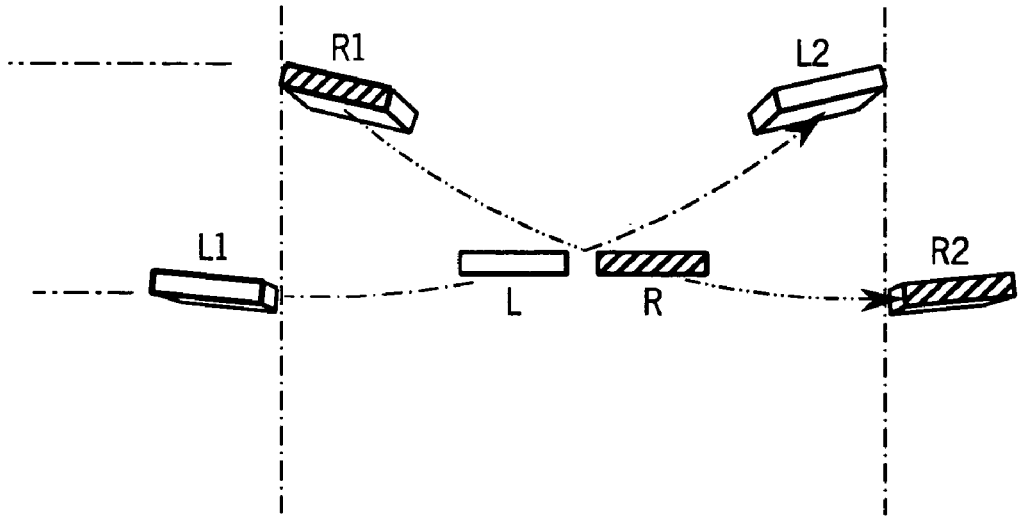
FIG. 10 shows a front, elevational schematic of the footpads of the embodiment of FIG. 9.
Figure 11:
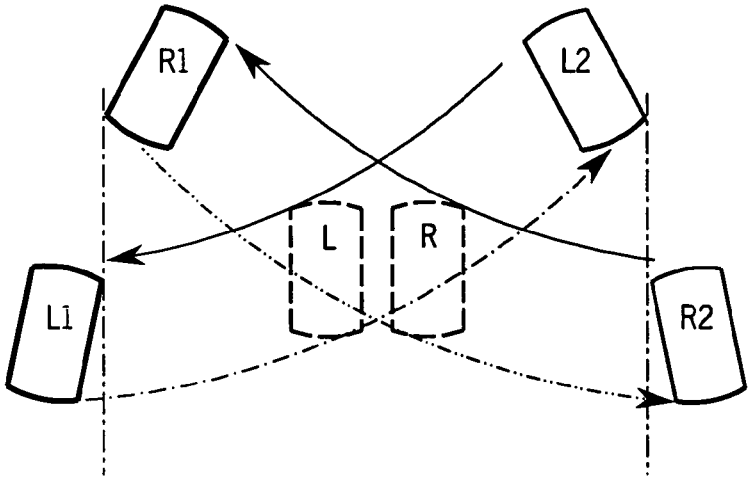
FIG. 11 shows an overhead schematic of the footpads of the embodiment of FIG. 9.

Referring now to FIGS. 9-12, FIG. 9 shows a front, elevational schematic of an additional embodiment of an exercise device in accordance with the principles of the present invention (with the sprocket assembly and the hand supports removed for ease of reference), FIG. 10 shows a rear, elevational schematic of the footpads of this embodiment while FIG. 11 shows an overhead schematic of the footpads.

In the embodiment depicted in FIGS. 9-12, the first and second swing arm pivots 24 and 35 are offset below, and shifted with respect to, the first and second follower arm pivots 26 and 35. Therefore, the distance between the first swing arm pivot 24 and the first follower arm pivot 26 is less then the distances between the first swing arm foot pivot 44 and the first follower arm foot pivot 46. Likewise, the distance between the second swing arm pivot 35 and the second follower arm pivot 37 is less than the distance between the first swing arm foot pivot 55 and the first follower arm foot pivot 57. And the lengths of the first and second swing arms 20 and 33 are less then the lengths of the first and second follower arms 22 and 34.

Thus, in this embodiment, the four-bar linkage results in the footpads establishing a generally raised position from parallel relative to horizontal at the outer bounds of the swinging motion (seen in FIG. 10) while the footpads 40 and 51 turn inward at the outer and inward bounds of the swinging motion from their parallel orientation at the center, neutral position (seen in FIG. 11). In this embodiment, the upper surface of the footpads rotate (or tilt) with respect to a horizontal plane within the range of about zero degrees (0°) to about twenty degrees (20°). In another embodiment, the upper surface of the footpads can rotate (or tilt) with respect to a horizontal plane within the range of about zero degrees (0°) to about 10 degrees (10°).

Figure 12:
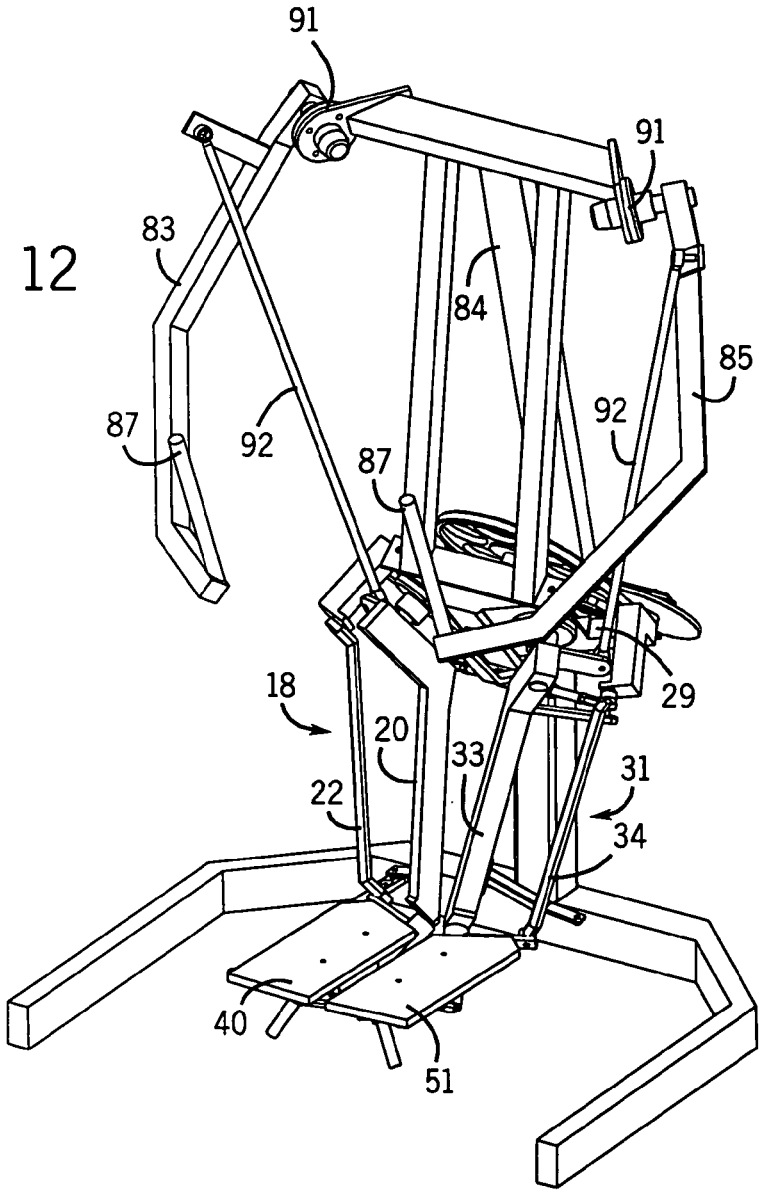
FIG. 12 is a front perspective view of the exercise device of FIG. 1 having arm support assemblies in accordance with the principles of the present invention

In a further embodiment, the exercise device in accordance with the principles of the present invention can provide arm support assemblies. Referring to FIG. 12, a front perspective view of an exercise device having arm support assemblies in accordance with the principles of the present invention is seen, where like elements are numbered the same as in the prior embodiment. An arm assembly support 84 can be connected to the upper portion of the transverse support member 29. A first swing arm support 83 and a second swing arm support 85 are provided. The swing arm supports 83, 85 can be pivotally attached to the arm assembly support 84 by hubs 91. To coordinate the movement of the arm support assemblies with the movement of the footpads 40, 51, the swing arm support assemblies 83, 85 can further be connected to the swing arms 20, 33 by an upper arm pivot link 92. The swing arm support assemblies 83, 85 can include a pair of hand supports 87 for grasping by a user while utilizing the present exercise device 10. The hand supports 87 can be of a continuous shape to accommodate users of various sizes and heights and to provide for multiple hand positions during use. The hand supports 87 may be in part or in whole covered by a gripping material or surface, such as tape, foamed synthetic rubber, etc. Alternatively, the hand supports may be pivotally mounted to the swing arms.

Figure 13:
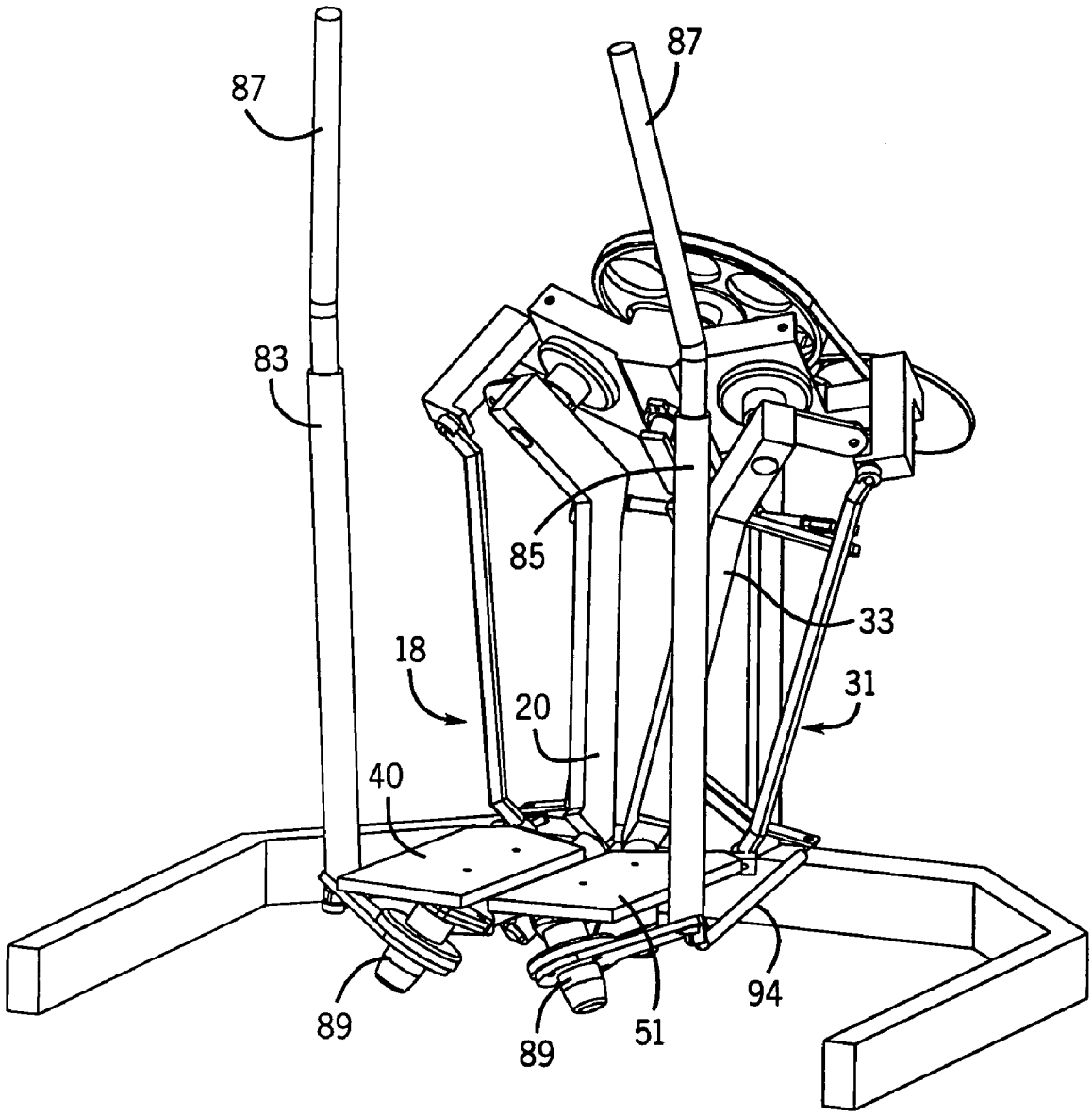
FIG. 13 is a front perspective view of the exercise device of FIG. 1 having alternative arm support assemblies in accordance with the principles of the present invention.

Referring to FIG. 13, in another embodiment the swing arm support assemblies 83, 85 can be pivotally connect to the underside of the footpads 40, 51 by hubs 89. To coordinate the movement of the swing arm support assemblies 83, 85 with the movement of the footpads 40, 51, the swing arm support assemblies 83, 85 can further be connected to the swing arms 20, 33 by a pair of low arm pivot links 94. Thus, in use when the corresponding footpad moves in the outward direction, the swing arm support assembly pivots off of hub 89 in the opposite direction; likewise, when the corresponding footpad moves in the inward direction, the swing arm support assembly pivots off of hub 89 in the opposite direction. In an additional embodiment, the swing arm support assemblies 83, 85 can be non-pivotally secured to the footpads 40, 51 and thus move with the corresponding footpad. A pair of hand supports 87 can be provided on the swing arm support assemblies 83, 85, which again are of a continuous shape to accommodate users of various sizes and heights and to provide for multiple hand positions during use. In this alternative embodiment, the profile and weight of the exercise device is improved over the prior embodiment, thus enhancing portability.

While in the embodiments described in FIGS. 12 and 13, the motion of the pendulum assemblies is coordinated with the swing arm support assemblies, in another embodiment the pendulum assemblies can be free to move independently with respect to the swing arm support assemblies. Accordingly, in this alternative embodiment a user to operate can swing the swing arm supports at the same rate, or at a different rate, as the motion of the pendulum assemblies. Further, this embodiment enables a user to operate the swing arm support assemblies with respect to the pendulum assemblies in a manner that is opposite of the motion of the pendulum assemblies. In a further embodiment, the motion of the pendulum assemblies can be linked with swing arm support assemblies to provide a motion that is concert with the motion of the pendulum assemblies.

Figure 14:
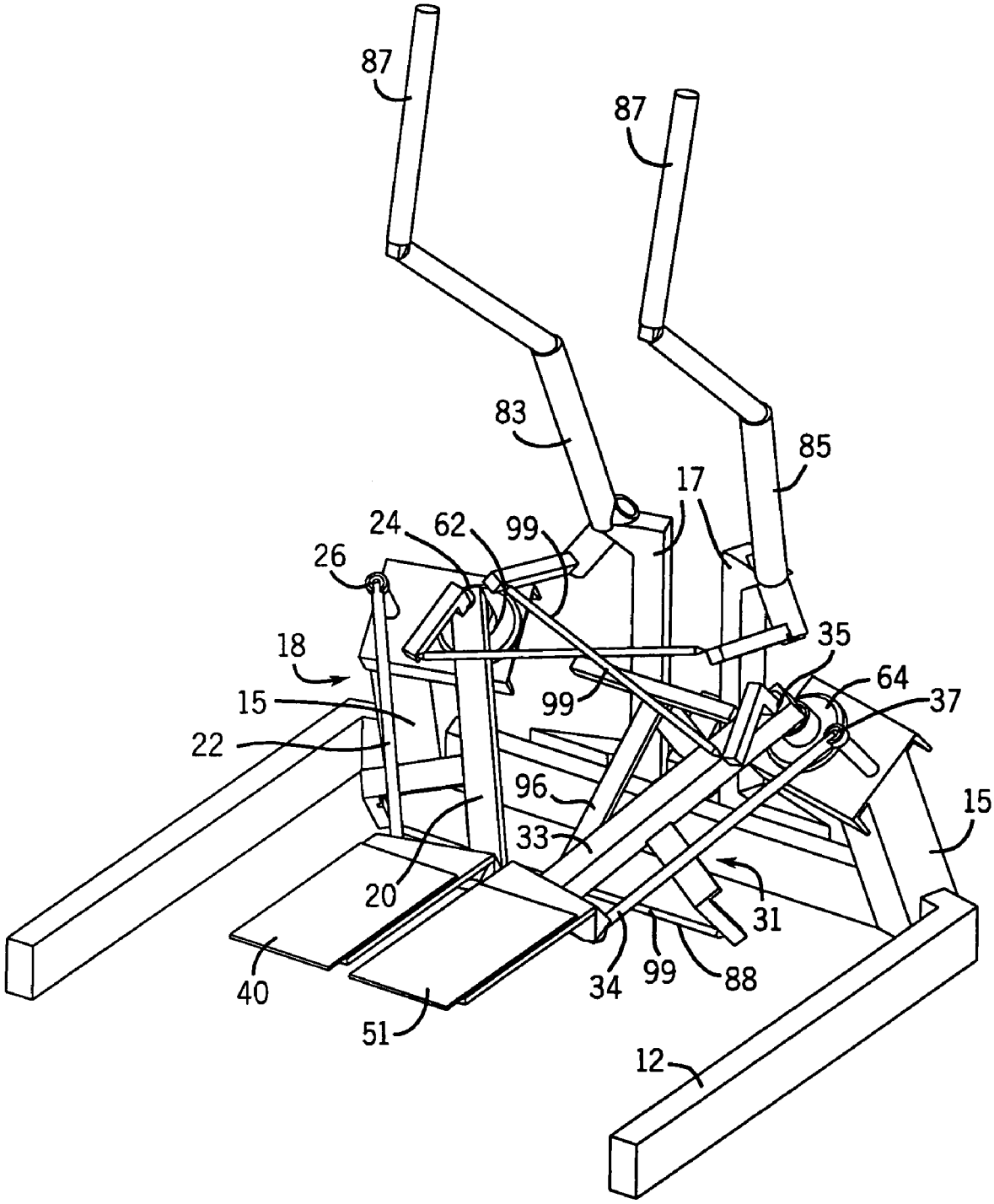
FIG. 14 is a front perspective of an alternative embodiment of an exercise device in accordance with the principles of the present invention.
Figure 15:
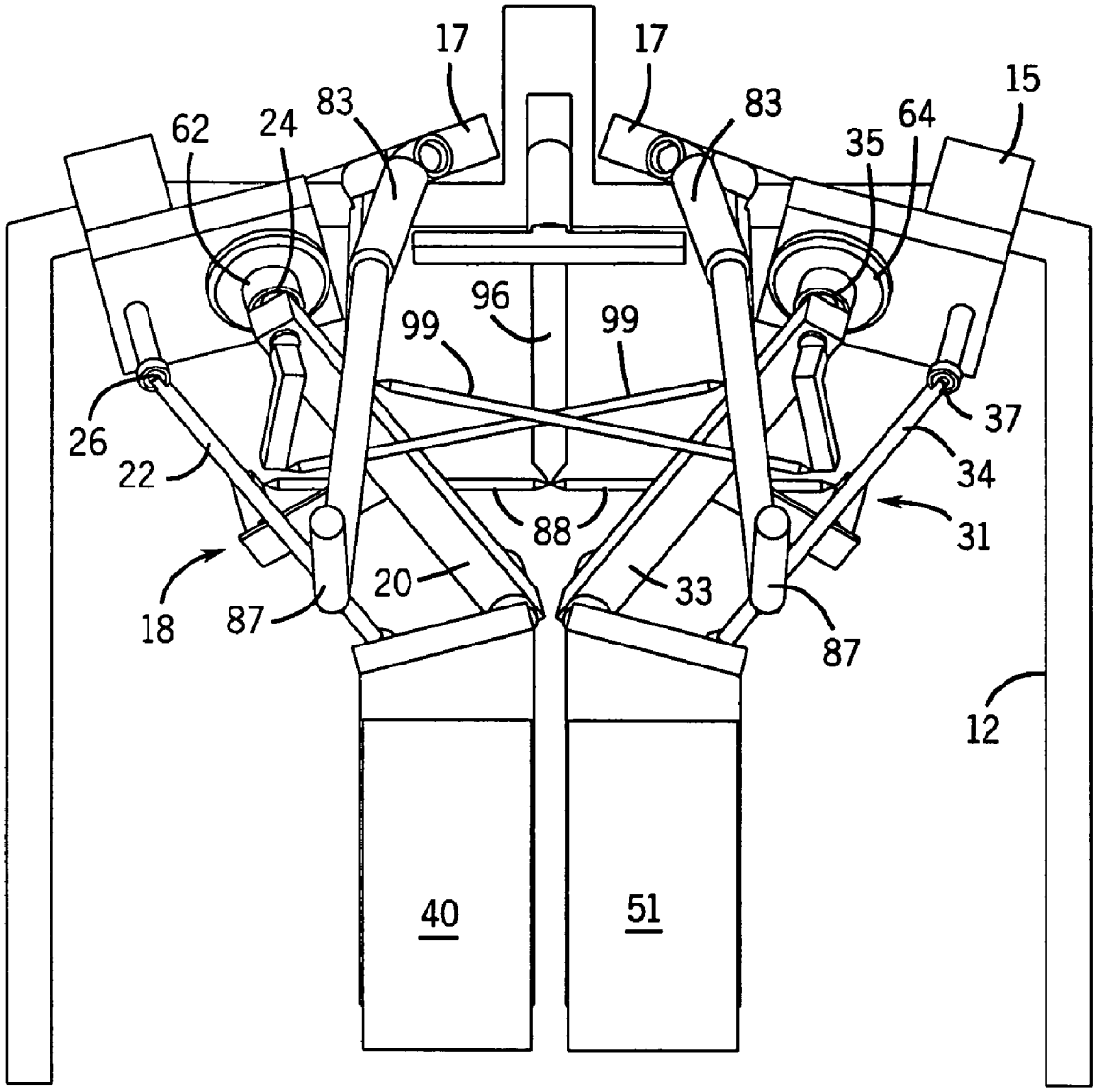
FIG. 15 is an overhead view of the exercise device of FIG. 14.

Referring now to FIGS. 14 and 15, another alternative embodiment of the present invention is seen. In this embodiment, the base 12 has a pair of swing assembly bases 15 and a pair of swing arm bases 17 extending upwardly. The first pendulum assembly 18 and second pendulum assembly 31 are rotatably connected to the swing assembly bases 15 by swing arm pivot 24, 35 and follower arm pivots 26, 37, respectively. A pair of cross links 88 connect each swing arm support assembly 83, 85 to the respective arm 33, 20. A mid link 96 is rotatably connected to the base 12. The mid link 96 (best seen in FIG. 15) is connected to a pair of links 99, each of which is in turn connected to a respective arm 20, 33. Thus, the alternative embodiment of FIGS. 14 and 15 represents a lower cost, relatively portable embodiment of the present invention.

Figure 16:
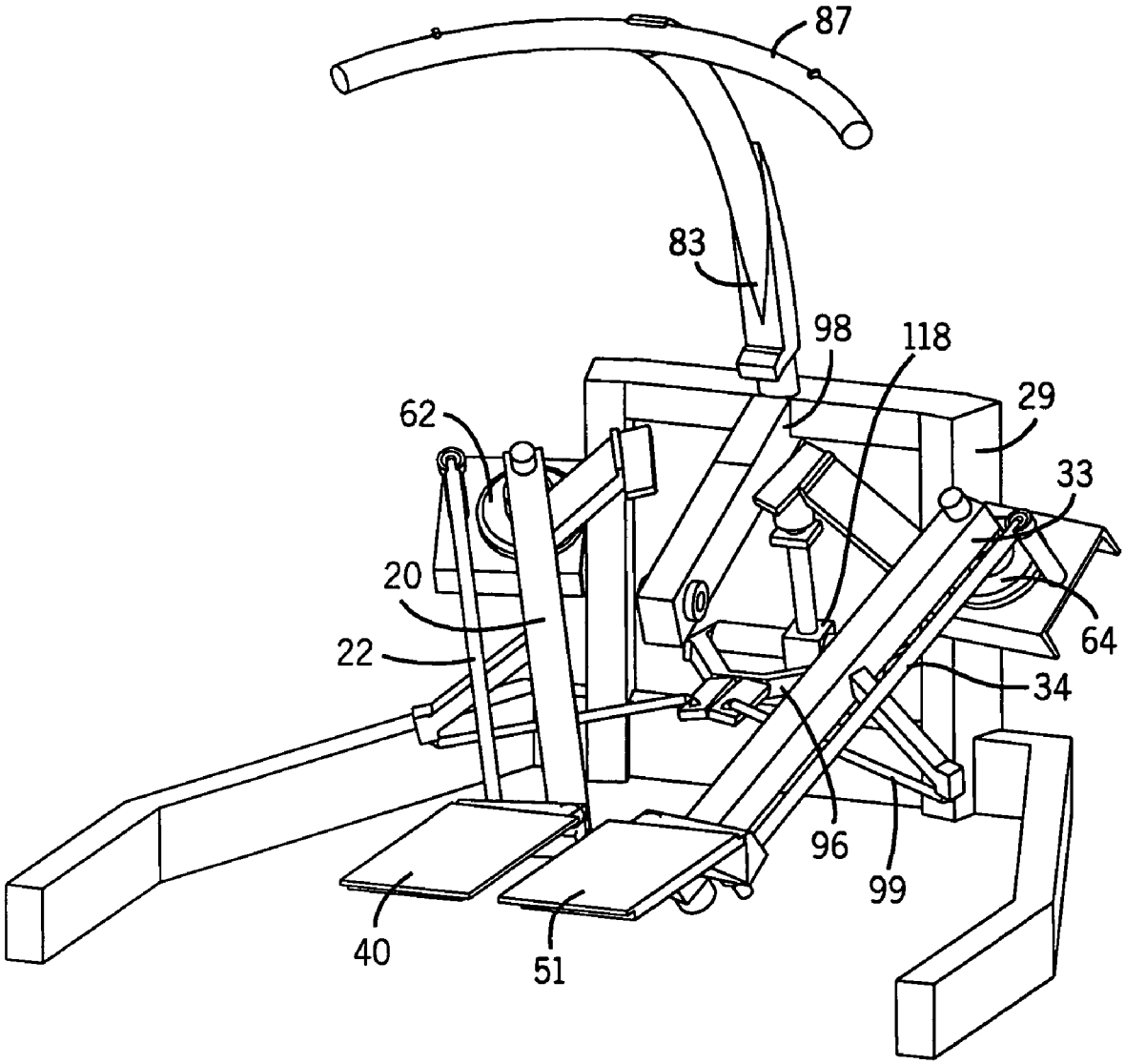
FIG. 16 is a front perspective of an alternative embodiment of an exercise device in accordance with the principles of the present invention.

Referring now to FIG. 16, another alternative embodiment of the present invention is seen. In this embodiment, a single swing arm extends upwardly from the base 12. A single swing arm support assembly 83 is rotatably connected to the transverse support member 29 by a hub 98. A single hand support 87 is connected to the swing arm support assembly 83. The single hand support 87 includes a left and a right portion and is configured such that a user can grasp the single hand support 87 with one or both hands (as desired). A mid link 96 is connected to a pair of links 99, each of which is in turn connected to a respective arm 20, 33. Thus, the alternative embodiment of FIG. 16 represents a lower cost, relatively portable embodiment of the present invention.

Figure 17:
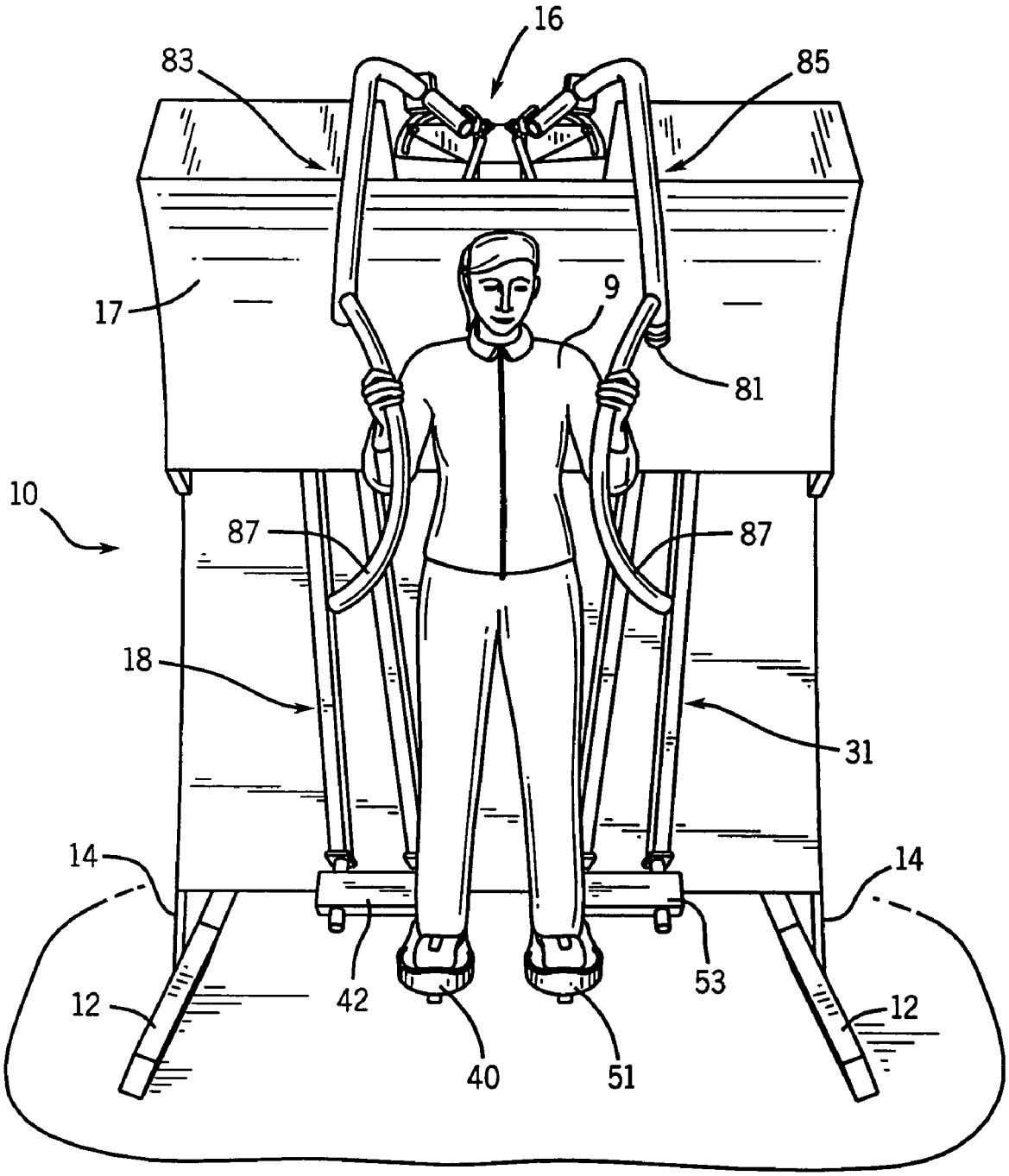
FIG. 17 is a front perspective view of a user on an alternative embodiment of an exercise device in accordance with the principles of the present invention.

Referring to FIG. 17, a front perspective view of a user on an additional embodiment of an exercise device in accordance with the principles of the present invention is seen, with a shroud 17 covering the mechanics of the exercise device. FIG. 17 shows a user in the beginning, central or neutral position. The user 9 stands on the pair of footpads 40, 51 supported by the swing assembly 16 and can gain further support by holding on to a pair of hand supports 87.

Figure 18:
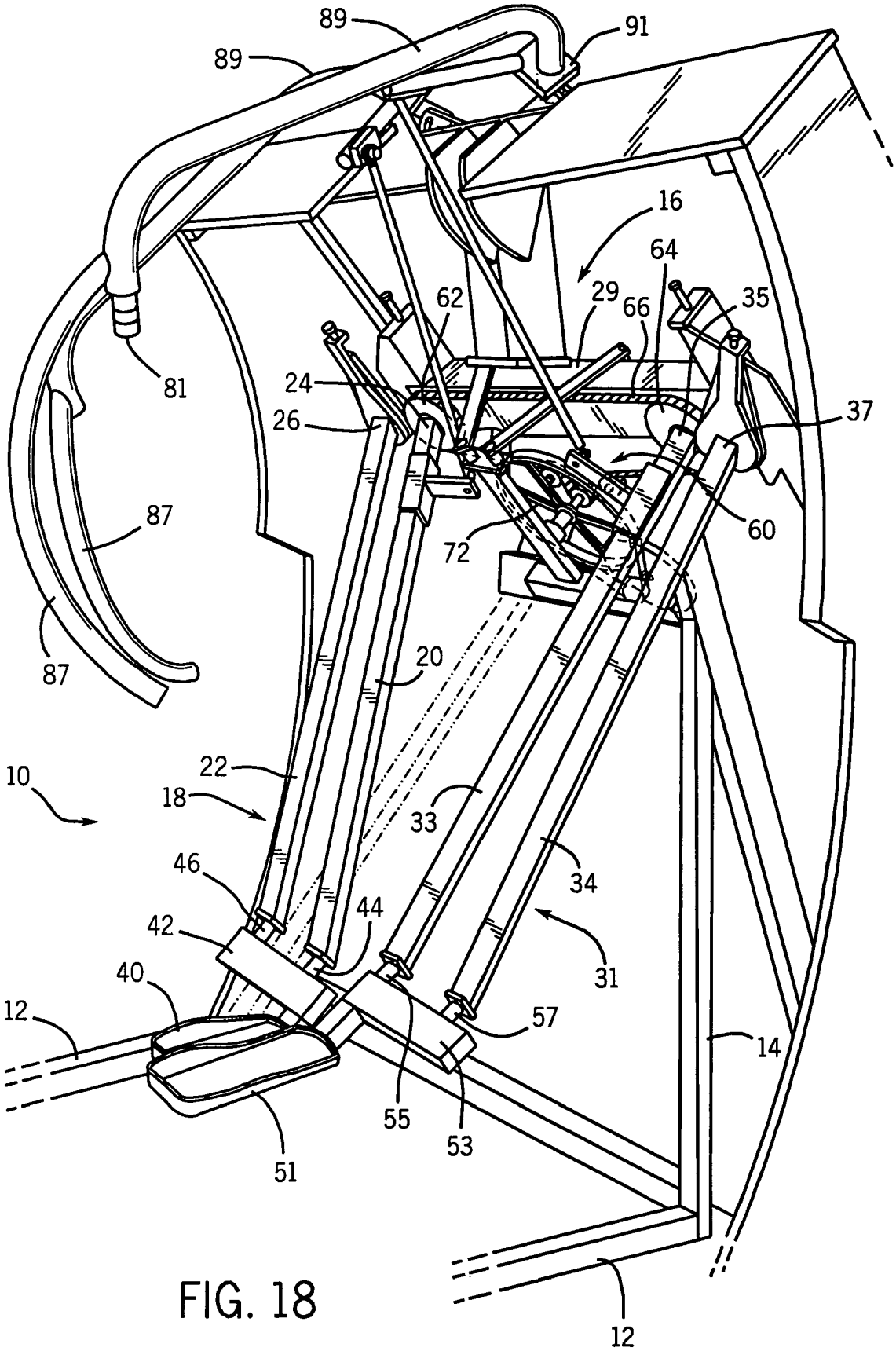
FIG. 18 is an angled perspective view of the exercise device of FIG. 17 with a portion of the shroud removed.
Figure 19:
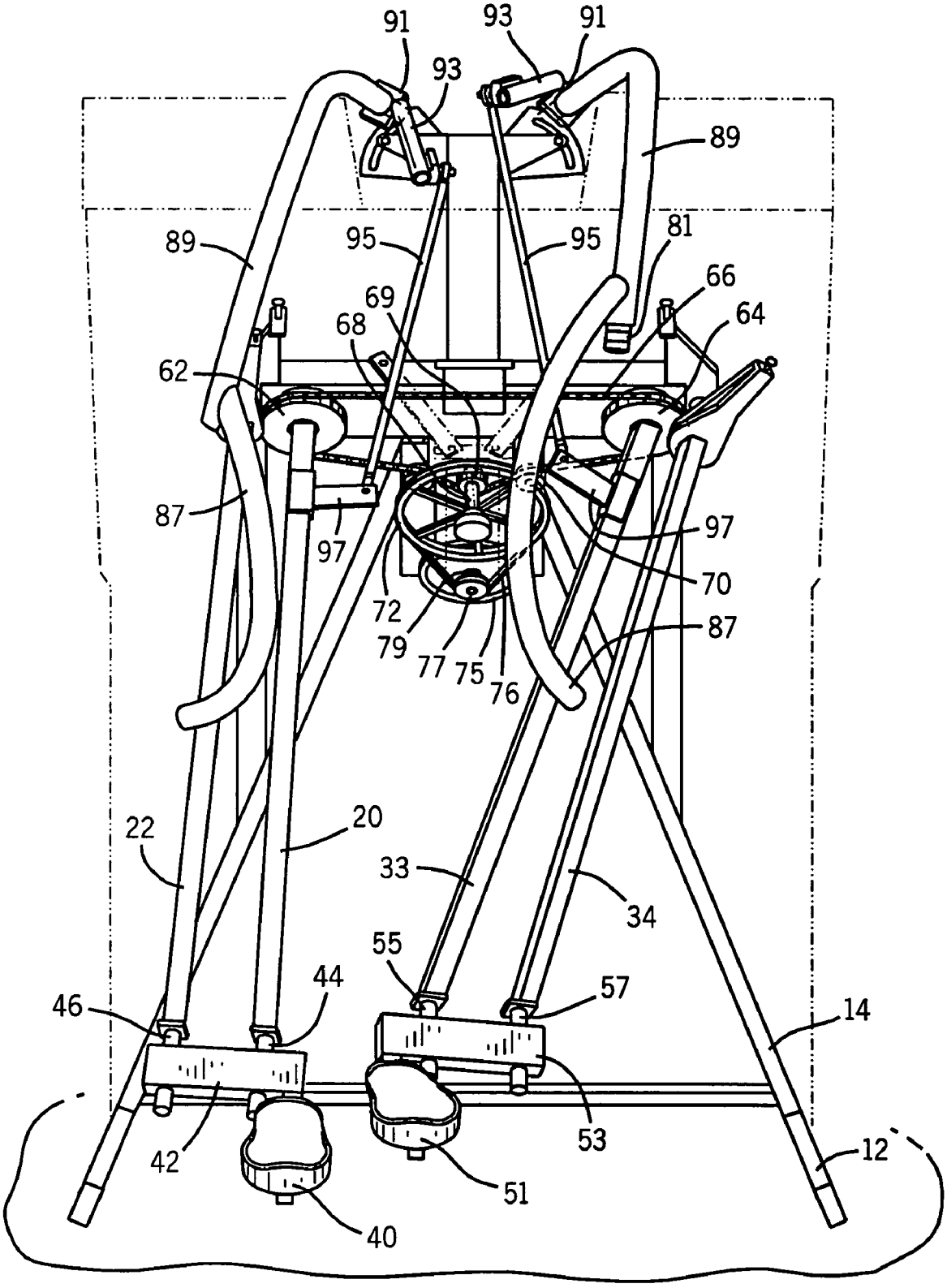
FIG. 19 is an elevated front view of the exercise device of FIG. 17 with the shroud removed.
Figure 20:
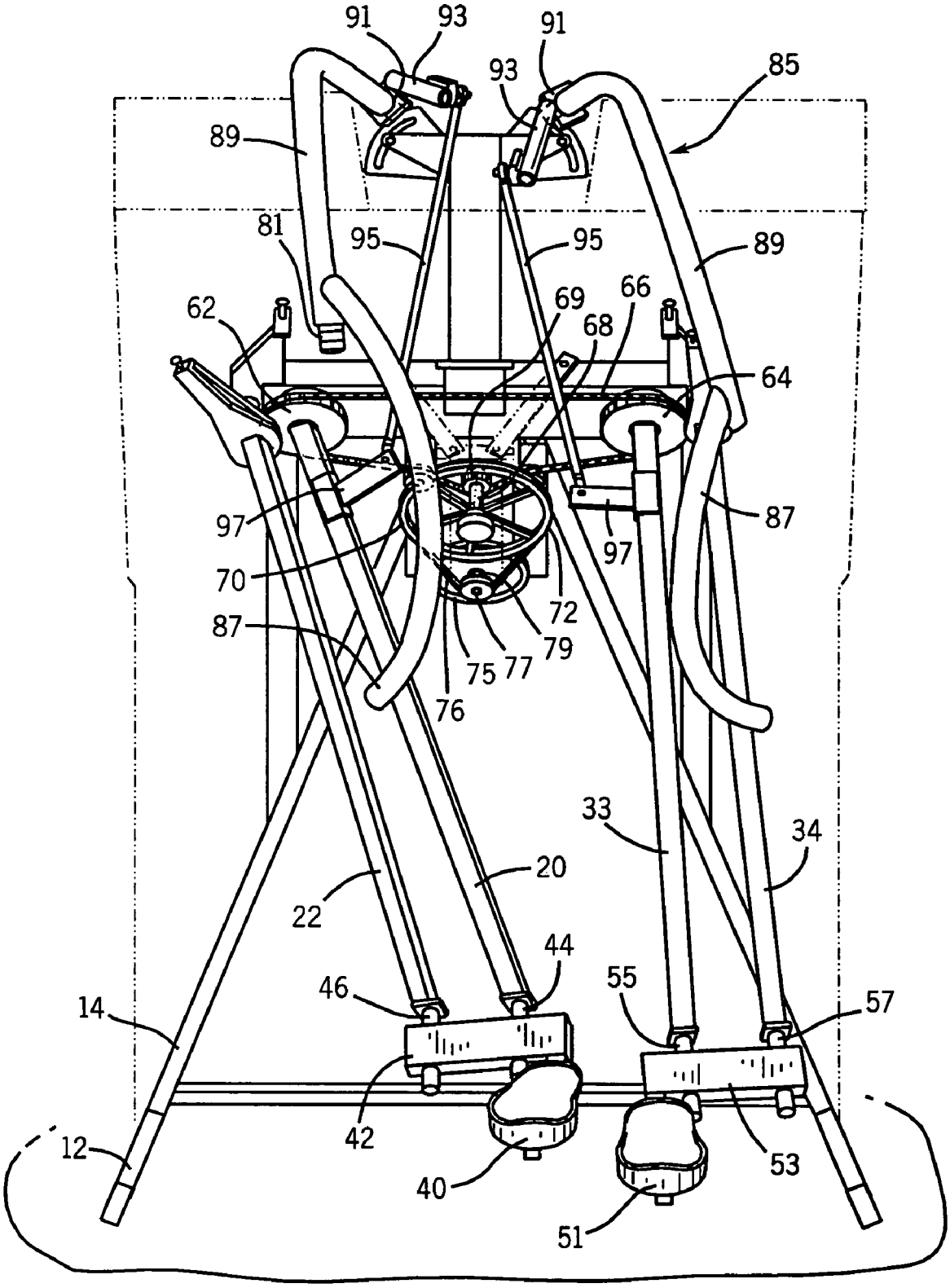
FIG. 20 is an elevated front view of the exercise device of FIG. 19 in a different position.

Referring to FIG. 18, an angled, front perspective view of the exercise device 10 of FIG. 17 is seen. In FIG. 18, a portion of the shroud 17 that can cover the swing assembly 16 has been removed to expose the swing assembly 16. The swing assembly 16 includes a first pendulum assembly 18 and second pendulum assembly 31. FIG. 19 illustrates the first pendulum assembly 18 and the second pendulum assembly 31 swung to a left position when viewed from the front of the exercise device 10. FIG. 20 illustrates the first pendulum assembly 18 and the second pendulum assembly 31 swung to a right position when viewed from the front of the exercise device 10.

Referring to FIGS. 18-20, the motion of the first pendulum assembly 18 and the second pendulum assembly 31 can be coordinated and/or synchronized by use of a cross-coupling assembly, such as for example a sprocket assembly 60 mounted on the transverse support member 29 of the frame 14. The sprocket assembly 60 can include first and second socket gears 62 and 64 attached to the first and second swing arm pivots 24 and 35, respectively. A chain 66 can connect the first and second socket gears 62 and 64 to a shaft 68 having a socket gear 69. The chain 66 can be maintained taut by use of at least one idler gear 70. The shaft 68 can be coupled to a flywheel 72 as known to smooth the motion of the exercise device. While the exercise device 10 described herein utilizes a sprocket assembly as the cross-coupling assembly to coordinate the motion of the first and second pendulum assemblies, various alternative mechanical arrangements for the cross-coupling assembly may be employed such as, for example, a linkage or linkages, a pulley system, a cam system, or an electro-mechanical system.

The present invention can include a load application system for selectively applying a braking or retarding force on the motion of the first and second pendulum assemblies 18 and 31. The flywheel 72 can act as a step-up pulley to drive a smaller driven sheave 77 via a belt 76. The driven sheave 77 can be mounted on a rotatable stub shaft 79. A load applicator 75 can be provided, such as, for example, an eddy current brake assembly. The eddy current brake assembly can include a solid metallic disk mounted on the stub shaft 79 inboard of driven sheave 77 to also rotate with the driven sheave 77. An annular faceplate of highly electrically conductive material, e.g., copper, can be mounted on the face of the solid disk. A pair of magnet assemblies can be mounted closely adjacent the face of the solid disk opposite the annular plate. The magnet assemblies each include a central core in the form of a bar magnet surrounded by a coil assembly. The magnet assemblies can be positioned along the outer perimeter portion of the disk in alignment with the annular plate. The location of the magnet assemblies may be adjusted relative to the adjacent face of the disk so as to be positioned as closely as possible to the disk without actually touching or interfering with the rotation of the disk. As noted above, the difference in size between the diameters of flywheel 72 and driven sheave 77 results in a step up in rotational speed of the disk relative to the motion of the first and second pendulum assemblies. The rotational speed of the disk is thereby sufficient to produce relatively high levels of braking torque through the eddy current brake assembly.

A resistance control can be provided that controls the load application system. The resistance can be transmitted to a central processing unit (CPU) provided with the exercise device through an analog to digital interface and controller. In one embodiment, a dial control 81 can be provided on or adjacent to one of the hand supports 87, as best seen in FIG. 18.

Referring to FIGS. 18-20, the swing assembly 16 further comprises a first swing arm support assembly 83 and a second swing arm support assembly 85. The hand supports 87 can be of an arcuate, continuous shape to accommodate users of various sizes and heights and to provide for multiple hand positions during use. In one embodiment, each of the hand supports 87 can be an elongate curved bar or rod having a length that is equal to or less than the distance established from a first location having a height that is approximately 18 inches above the head of a user to a second location having a height that is approximately the height of the hips of a user. In another embodiment, the hand support can extend from a height that is the approximate height of the head of a user to a height that is approximately the height of the hips of a user. In another embodiment, each hand support has a length within the range of approximately 8 to 48 inches. In one particularly preferred embodiment, each hand support has a length within the range of 12 to 18 inches. In other preferred embodiments, other lengths for the hand supports are contemplated. In one embodiment, the hand supports 87 can have a radius of curvature within the range of 18 inches to 5 feet. The shape of the arcuate hand supports can be generally semi-circular, a semi-elliptical, or any curved shape extending along at least a portion of the hand supports.

The hand supports 87 are bowed away from a user such that the upper and lower regions of the hand supports 87 extend toward a user during use. This hand support configuration enables a user to readily and efficiently reposition his or her hands during use without having to over-extend, reach or abnormally twist his or her body. The curved or bowed configuration of the hand supports 87 provide multiple grasping locations for a user to readily and comfortable perform a variety of arm motions including, pulling down, pushing up, pushing away, pulling in, and any combination of such movements. The large variety of hand positions available to a user by the hand supports 87 provides the user with the ability to exercise different arm and upper body muscles by simply repositioning his or her hands about the hand supports 87. Other hand supports configurations can also be used.

The hand supports 87 can be connected to a pair of support links 89. The support links 89 can be pivotally connected to an upper portion of the frame 14 at hand support pivots 91. The hand support pivots 91 can be angled with respect to vertical to enable the hand supports 87 and the support links 89 to swing in a front-to-back, side-to-side and up-and-down combined motion. Extending from the hand support pivots 91 are hand follower bars 93 that engage linkage members 95. The linkage members 95 engage swing arm follower bars 97, which can be attached to first and second swing arms 20 and 33, respectively. The linkage between the hand supports 87 and first and second swing arms 20 and 33 coordinate front-to-back, side-to-side and up-and-down movement of the hand supports 87 with the front-to-back, side-to-side and up-and-down movement of the footpads. In alternative embodiments, other linkage configurations or equivalent structures for coordinating the movement of the first and second swing arm support assemblies 83 and 85 with the first and second pendulum assemblies 18 and 31 can be used.

Figure 21:
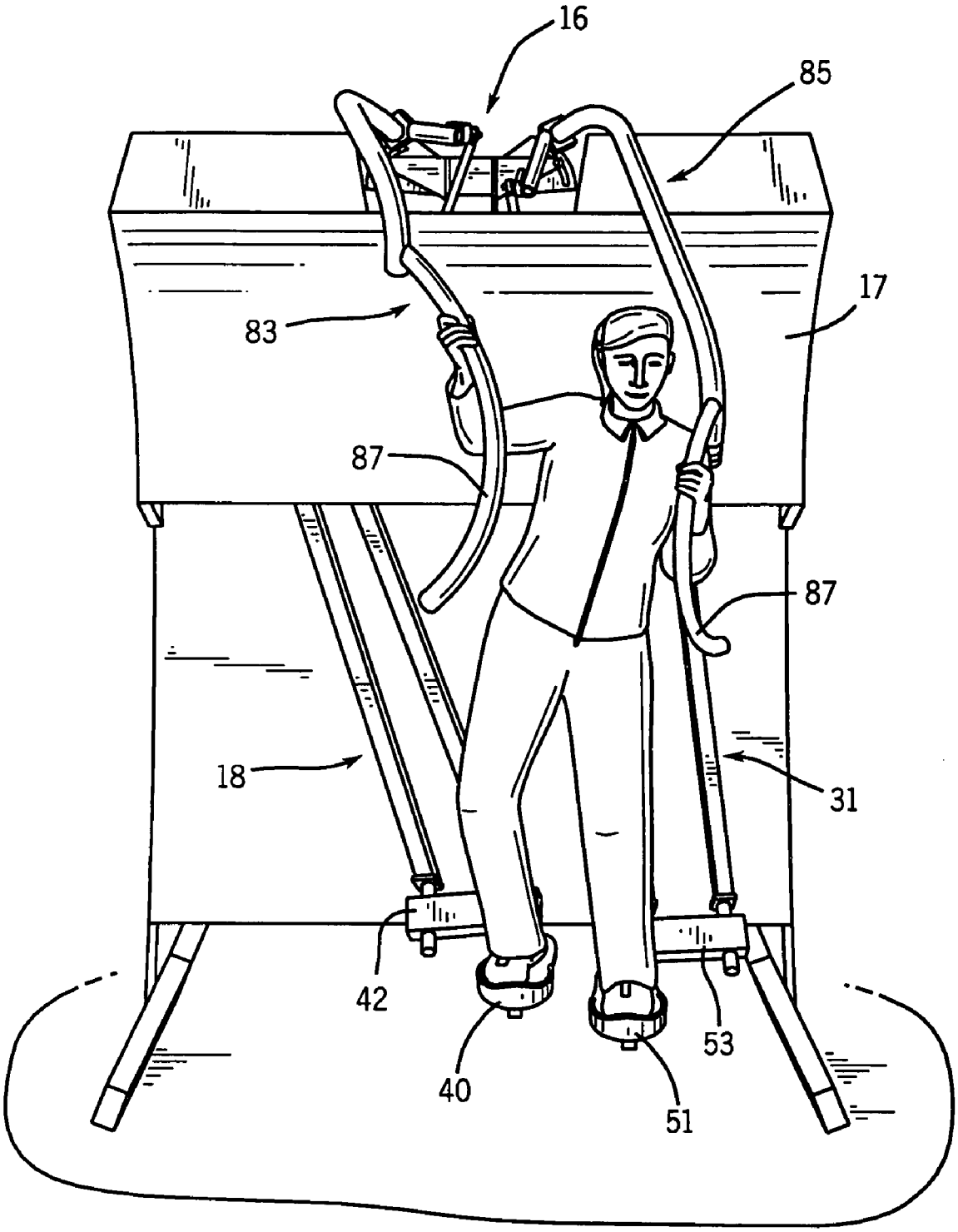
FIG. 21 is a front perspective view of a user in one position on the exercise device of FIG. 17.
Figure 22:
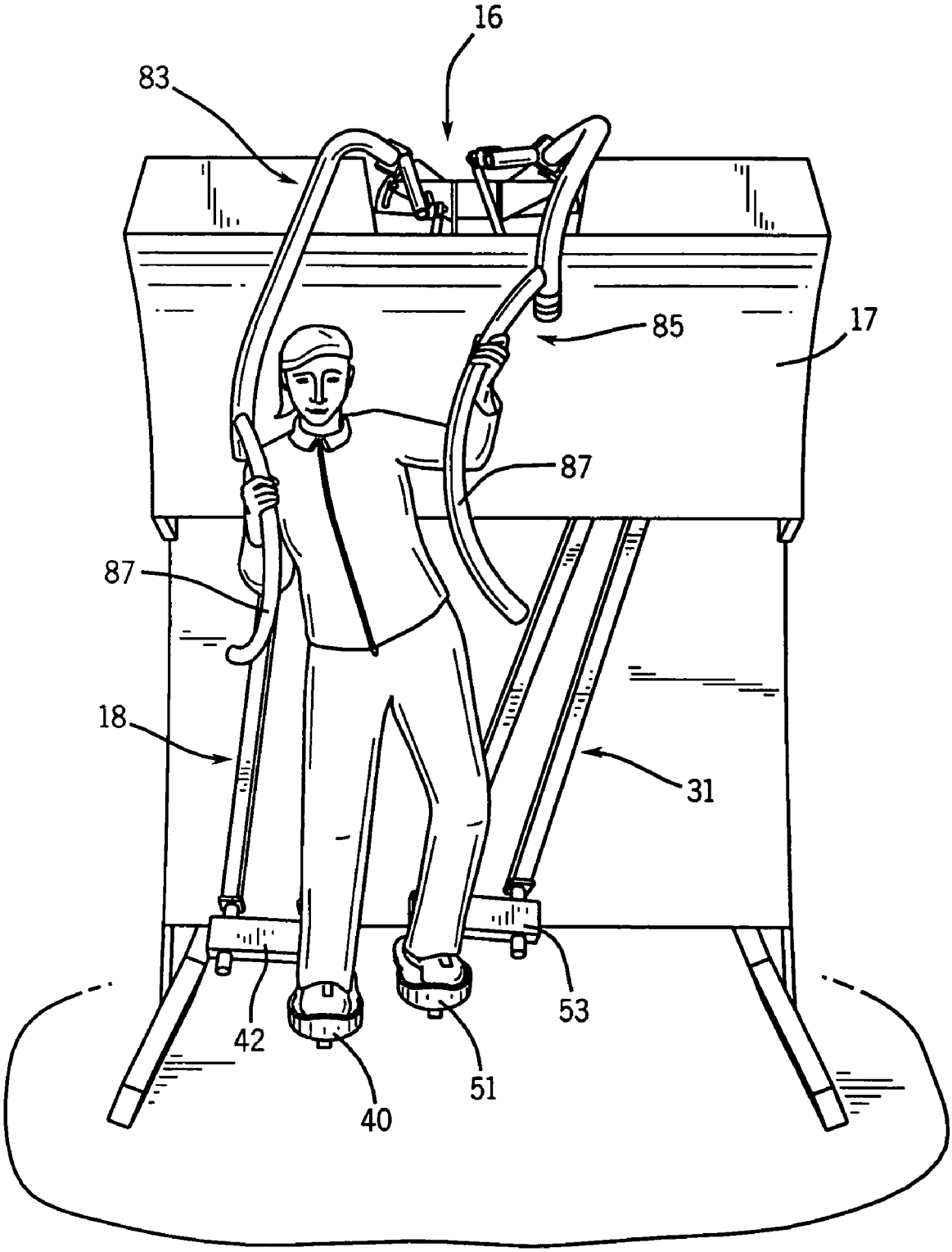
FIG. 22 is a front perspective view of a user in another position on the exercise device of FIG. 17.
Figure 23:
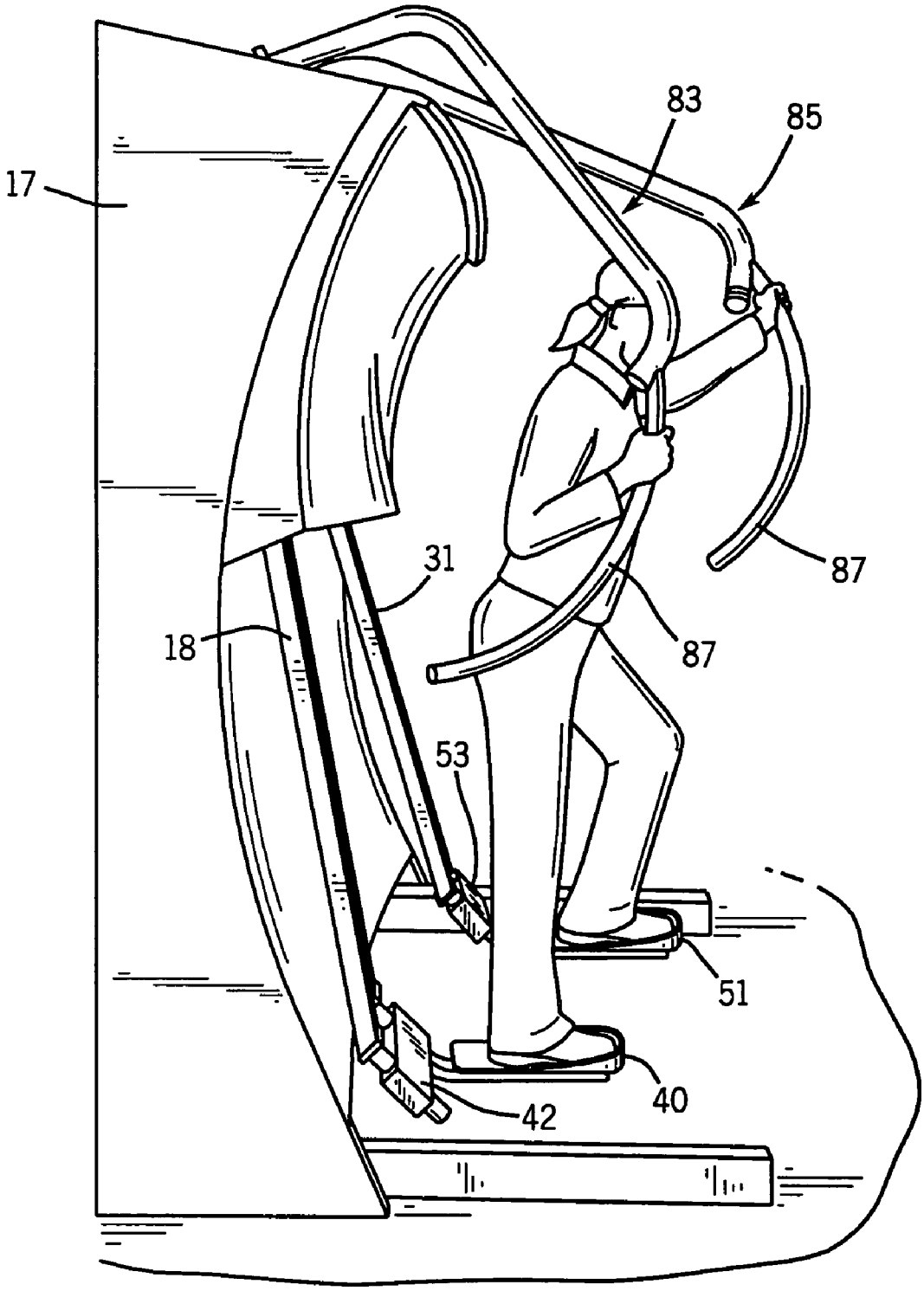
FIG. 23 is a side perspective view of a user on the exercise device of FIG. 17 with a portion of the shroud removed.

Referring to FIGS. 21-23, to use the present invention a user stands on the footpads 40, 51, with the footpads 40 and 51 in a neutral centered position, while gripping the hand supports 87. A user can shift his or her weight to one side thereby imparting a downward force on one footpad, while reducing force on the other footpad thereby causing the footpad on which the force is exerted to swing downward, rearward and outward while the footpad on which force is reduced swings upward, forward and inward. Importantly, the shifting of the weight of a user contributes to the motion of the exercise device. Further, the stroke or stride length of the exercise device is entirely user defined, thereby increasing the flexibility and versatility of the exercise device. A user can also use his or her arms to initiate or facilitate the motion of the exercise device. For example, a user can pull down one of the hand supports 87 while pushing up on the opposing hand support to initiate or facilitate the motion.

Upon achieving the desired swing motion, a user alternates the force imparted on the footpads 40, 51, thus imparting a downward force on the footpad on which force had previously been reduced while reducing force on the footpad on which force had previously been exerted. This opposes the inertial momentum of the swing assembly 16, causing the first pendulum assembly 18 and the second pendulum assembly 31 to reverse. This process can be repeated causing the first pendulum assembly 18 and the second pendulum assembly 31 to swing from side-to-side, forward and rearward, and up-and-down. The user can further contribute to the swinging motion of the exercise device 10, by pushing and/or pulling the hand supports 87 in coordination with the alternating application of downward force onto the footpads 40 and 51.

Referring to FIG. 21, the weight of a user is shifted to the second footpad 51, thereby causing the second footpad 51 to move downward, outward and rearward, and the first footpad 40 to move upward, inward and forward. In coordination with the movement of the first and second footpads 40 and 51, the user can pull the hand support 87 downward, rearward and outward with the left hand and push the other hand support 87 upward, forward and inward with the right hand. The user can readily control or vary the amount of force that is applied in an upward or downward direction versus a forward or rearward direction by repositioning his or her hands about the hand support 87. Accordingly, the hand supports 87 provide the user with a large variety of available exercise routines while using the exercise device 10.

Referring to FIGS. 21 and 23, a user is shown with her weight shifted toward the first footpad 40, thereby causing the first footpad 40 to move downward, rearward and outward while the second footpad 51 moves upward, forward and inward. A user also pulls one hand support 87 rearward, downward and outward with her right hand while pushing the other hand support 87 upward, forward and inward with her left hand.

Figure 24:
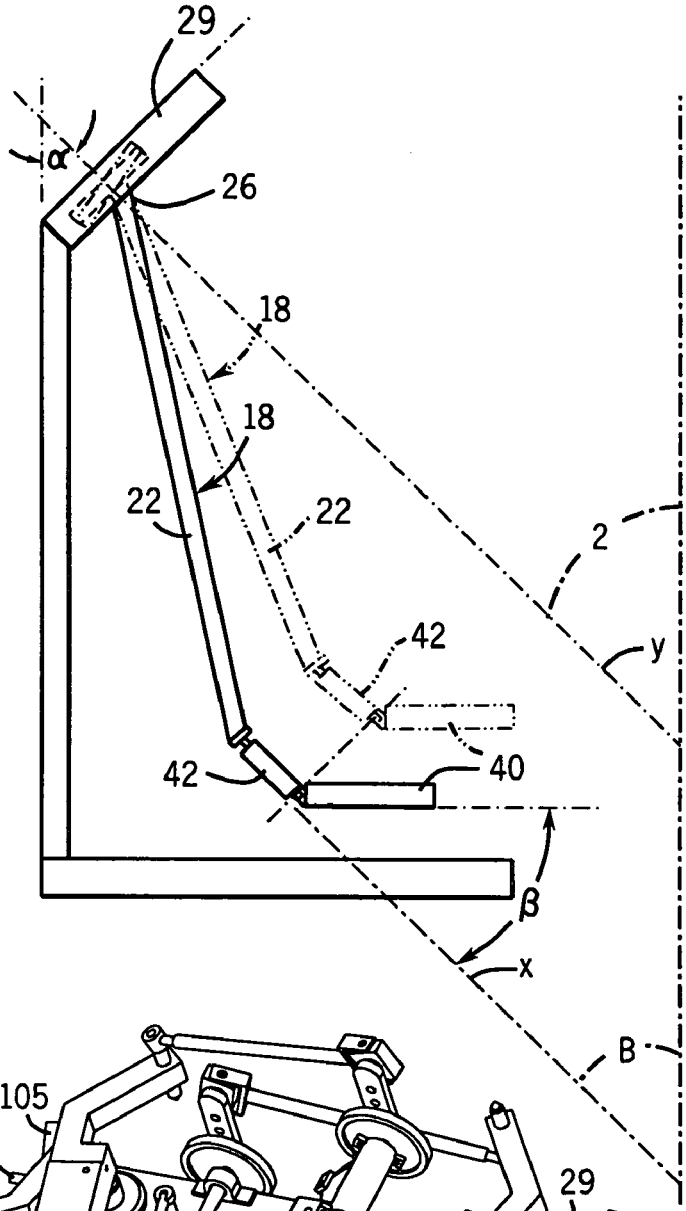
FIG. 24 is a side, elevational schematic of an additional embodiment of an exercise device having an adjustable angle in accordance with the principles of the present invention.

In another embodiment of the present invention, an exercise device in accordance with the principles of the present invention can have a user adjustable angle. Referring to FIG. 24, a side, elevational schematic of an exercise device in accordance with the principles of the present invention is seen. In accordance with the present invention, a first angle $\alpha$ is defined by the angle between the upper pivot point and vertical; and a second angle $\beta$ is defined by the angle between the footpad support 42 and vertical. The first angle $\alpha$ and the second angle $\beta$ are approximately the same; thus, the axis x defined by the angle of the footpad support 42 and the axis y defined by the upper pivot point are generally parallel. The distance between the axes x and y in combination with the size of the first angle $\alpha$ or the second angle $\beta$ define the particular three dimensional motion of the exercise device.

The larger the first angle $\alpha$ becomes (the phantom follower arms and footpad in FIG. 24) the greater the forward/rearward motion and the less the rise; likewise, the smaller the first angle $\alpha$ becomes the less the forward/rearward motion and the greater the rise. In one embodiment, the first angle $\alpha$ and the second angle $\beta$ can be between about one degree (1°) to about eighty-nine degrees (89°); in a preferred embodiment, the first angle $\alpha$ and the second angle $\beta$ can be between about twenty degrees (20°) to about seventy degrees (70°)).

Figure 25:
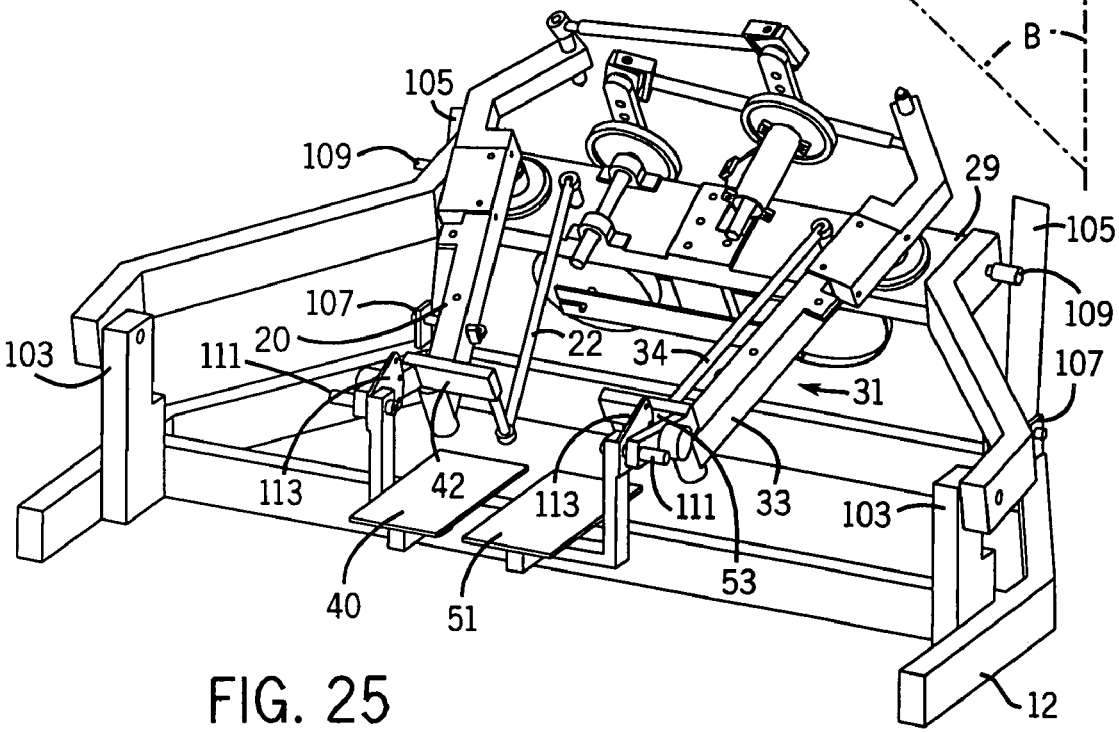
FIG. 25 is a front perspective view of an additional embodiment of an exercise device having an adjustable angle in accordance with the principles of the present invention.

Referring to FIG. 25, a front perspective view of an exercise device having a user adjustable angle in accordance with the principles of the present invention is seen. In this embodiment, the upper transverse support member 29 is pivotally connected at pivot points 103 to the base 12 such that the angle of the upper support member 29 can be altered. A pair of supports 105 are pivotally connected to the base at a pivot point 107. The upper transverse support member 29 includes a pair of pins 109. The pair of supports 105 include a plurality of apertures that cooperate with the pins to secure the upper transverse support member 29 at different angular positions.

In addition, the first footpad 40 and the second footpad 51 are pivotally coupled to the first footpad support 42 and the second footpad support 53 at pivot points 111 such that the angle of the footpads 40, 51 can be altered in conjunction with the angle of the upper support member 29. The first footpad 40 and the second footpad 51 include plates 113 which defined a plurality of apertures. The first footpad support 42 and the second footpad support 53 include retractable pins that cooperate with the apertures to secure the first footpad 40 and the second footpad 51 at different angular positions. While the adjustment mechanism described herein is manual, it should be appreciated that an automatic adjustment mechanism is within the scope of the present invention.

This alternative embodiment provides an exercise device that is significantly smaller but which maintains substantially the same motion of the present invention. This alternative embodiment can be made lightweight and portable and thus can used for example for coordinated classes in health clubs for multiple users. In addition, the embodiment of FIG. 25 is also potentially less expensive to produce, therefore making it more feasible for the non-institutional market.

In another embodiment of the present invention, the frame can also include a handrail or one or more hand grips. The handrail can upwardly extend from the base 12. The handrail can be used to provide additional support and stability to a user during use of the machine. Further, the handrail can be used in combination with, or in lieu of, the swing arm support assemblies.

Thus, an exercise device in accordance with the present invention provides a user with a natural fluid exercise motion incorporating a user-defined three dimensional stride length including a side-to-side, up-and-down, and front and back movement. The exercise device of the present invention can provide a translational movement of the entire body of a user. The exercise device enables a user to exercise muscles in a smooth natural manner over a large range of motion, without applying undesirable impact loads to the joints of a user. The exercise device incorporates this unique natural three directional movement in combination with an upper body exercise assembly to provide a complete total body exercise device. Further, the exercise device of the present invention enables a user to employ a large variety of different body positions and stride lengths when using the device. Significantly, the exercise device built in accordance with the present invention provides a user with a unique engaging motion that is enjoyable to use While the invention has been described with specific embodiments, other alternatives, modifications and variations will be apparent to those skilled in the art. Accordingly, it will be intended to include all such alternatives, modifications and variations set forth within the spirit and scope of the appended claims.

What is claimed is:

1. A pendulous exercise device comprising:

a frame;

first and second swing arms pivotally coupled to the frame by first and second pivots extending along first divergent axes so as to suspend the first and second swing arms from above and about the first divergent axes, the first and second swing arms extending from the frame at an angle from vertical when in rest position; and first and second footpads pivotally coupled to the first and second swing arms, respectively, so as to move along a footpath with respect to the frame each footpath comprising a forward/rearward component, an upward/downward component and an inward/outward component.

2. The exercise device of claim 1, wherein the angle from vertical is within the range of about one degree (1°) to about eighty-nine degrees (89°).

3. The exercise device of claim 1, wherein the angle from vertical is within the range of about twenty degrees (20°) to about seventy degrees (70°).

4. The exercise device of claim 1, further comprising first and second rigid follower arms extending along oblique axes and pivotally coupled to the first and second footpads, respectively, for pivotal movement about second divergent axes.

5. The exercise device of claim 4, wherein the first and second follower arms are pivotally coupled to the frame thereby forming first and second four-bar linkage assemblies.

6. The exercise device of claim 4, further comprising first and second cross links coupling the first and second follower arms to the first and second swing arms thereby forming third and fourth four-bar linkage assemblies with the first and second footpads.

7. The exercise device of claim 5, wherein the first and second four-bar linkage assemblies maintain a foot receiving surface of the first and second footpads in a substantially horizontal position as the first and second footpads travel along the footpath.

8. The exercise device of claim 5, wherein the first and second four-bar linkage assemblies are configured to control the tilting of a foot receiving surface of the first and second footpads within the range of 0 to 20 degrees with respect to a horizontal plane while in use.

9. The exercise device of claim 8 wherein the tilting of the foot receiving surface of the first and second footpads is within the range of 0 to 10 degrees with respect to the horizontal plane.

10. The exercise device of claim 6, wherein the third and fourth four-bar linkage assemblies maintain a foot receiving surface of the first and second footpads in a substantially horizontal position as the first and second footpads travel along the footpath.

11. The exercise device of claim 1, further comprising an assembly for coordinating the motion between the first and second footpads.

12. The exercise device of claim 11, wherein the assembly for coordinating the motion of the first and second footpads comprises sprocket and chain assembly.

13. The exercise device of claim 11, wherein the assembly for coordinating the motion of the first and second footpads comprises a linkage.

14. The exercise device of claim 1, further comprising a load application system operably coupled to the first and second swing arms.

15. The exercise device of claim 1, wherein the load application system comprises one or more of a brake assembly, an alternator and a generator.

16. The exercise device of claim 1, further comprising a flywheel operably coupled to the first and second swing arms.

17. The exercise device of claim 1, further comprising first and second swing arm support assemblies, and wherein each swing arm support assembly includes a hand grip.

18. The exercise device of claim 17, wherein the hand grip is an arcuate elongate member.

19. The exercise device of claim 17, further comprising an assembly operably coupling the first and second swing arm support assemblies to the first and second swing arms.

20. The exercise device of claim 19, further wherein the first and second swing arm support assemblies are coupled to the first and second footpads.

21. The exercise device of claim 19, wherein movement of the first and second swing arm support assemblies is coordinated with the movement of the first and second swing arms.

22. The exercise device of claim 19, wherein the assembly is a linkage.

23. A pendulous exercise device comprising:

a frame;

first and second swing arms pivotally coupled to the frame by first and second pivots extending along first divergent axes so as to suspend the first and second swing arms from above and about the first divergent axes, the first and second swing arms extending from the frame;

first and second footpads pivotally coupled to the first and second swing arms, respectively, so as to move along a footpath with respect to the frame each footpath having a forward/rearward component, an upward/downward component and an inward/outward component; and a swing arm adjustment assembly coupled to one of the frame and the first and second swing arms, the swing arm adjustment assembly positionable between a first position, wherein the first and second swing arms are positioned at a first angle from vertical, and at least a second position, wherein the first and second swing arms are positioned at a second angle from vertical.

24. The exercise device of claim 23, wherein the first and second angles are substantially equal to each other.

25. The exercise device of claim 24, wherein the first angle from vertical is within the range of about one degree (1.degree.) to about eighty-nine degrees(89°).

26. The exercise device of claim 25, wherein the first angle from vertical is within the range of about twenty degrees (20° to about seventy degrees (70°), and wherein the second angle is not equal to the first angle.

27. The exercise device of claim 23, further comprising first and second rigid follower arms extending along oblique axes and pivotally coupled to the first and second footpads, respectively, for pivotal movement about second divergent axes.

28. The exercise device of claim 27, wherein the first and second follower arms are pivotally coupled to the frame thereby forming first and second four-bar linkage assemblies.

29. The exercise device of claim 28, wherein the first and second four-bar linkage assemblies maintain a foot receiving surface of the first and second footpads in a substantially horizontal position as the first and second footpads travel along the footpath.

30. The exercise device of claim 28, wherein the first and second four-bar linkage assemblies are configured to control the tilting of a foot receiving surface of the first and second footpads within the range of 0 to 20 degrees with respect to a horizontal plane while in use.

31. The exercise device of claim 30 wherein the tilting of the foot receiving surface of the first and second footpads is within the range of 0 to 10 degrees with respect to the horizontal plane.

32. The exercise device of claim 27, further comprising first and second cross links coupling the first and second follower arms to the first and second swing arms thereby forming third and fourth four-bar linkage assemblies with the first and second footpads.

33. The exercise device of claim 32, wherein the third and fourth four-bar linkage assemblies maintain a foot receiving surface of the first and second footpads in a substantially horizontal position as the first and second footpads travel along the footpath.

34. The exercise device of claim 23, further comprising an assembly for coordinating the motion between the first and second footpads.

35. The exercise device of claim 34, wherein the assembly for coordinating the motion of the first and second footpads comprises sprocket and chain assembly.

36. The exercise device of claim 23, further comprising a load application system operably coupled to the first and second swing arms.

37. The exercise device of claim 23, further comprising a flywheel operably coupled to the first and second swing arms.

38. The exercise device of claim 23, further comprising first and second swing arm support assemblies, and wherein each swing arm support assembly includes a handgrip.

39. The exercise device of claim 38, further wherein the swing arm support assemblies include an arcute-shaped handgrip.

40. The exercise device of claim 38, further comprising an assembly operably coupling the first and second swing arm support assemblies to the first and second swing arms.

41. The exercise device of claim 40, further wherein the first and second swing arm support assemblies are coupled to the first and second footpads.

42. The exercise device of claim 40, wherein movement of the first and second swing arm support assemblies is coordinated with the movement of the first and second swing arms.

43. An exercise device comprising:

a frame;

first and second swing arms pivotally coupled to the frame by first and second pivots extending along first divergent axes so as to suspend the first and second swing arms from above and about the first divergent axes;

first and second footpads pivotally coupled to the first and second swing arms, respectively, so as to move along a footpath with respect to the frame each footpath having a forward/rearward component, an upward/downward component and an inward/outward component; and first and second swing arm supports coupled to first and second swing arms, respectively, each said swing arm support includes a hand grip.

44. The exercise device of claim 43, wherein each handgrip has a length within the range of 12 to 18 inches.

45. The exercise device of claim 43, wherein each handgrip has a radius of curvature within the range of 18 inches to 5 feet.

46. The exercise device of claim 43 wherein the first and second swing arms extend from the frame at an angle from vertical.

47. The exercise device of claim 43, wherein each handgrip is positioned at a height that generally overlaps the upper body of a user.

48. The exercise device of claim 43, further comprising an assembly operably coupling the first and second arm link assemblies to the first and second swing arms.

49. The exercise device of claim 48, wherein the assembly is a linkage.

50. The exercise device of claim 43, further comprising a load application system operably coupled to the first and second swing arms.

51. The exercise device of claim 43, further comprising a flywheel operably coupled to the first and second swing arms.

52. The exercise device of claim 43, further wherein the swing arm assemblies include an arcute-shaped handgrip.

53. The exercise device of claim 43, further comprising an assembly operably coupling the first and second swing arm assemblies to the first and second swing arms.

54. The exercise device of claim 43, further wherein the first and second swing arm assemblies are coupled to the first and second footpads.

55. The exercise device of claim 43, wherein movement of the first and second swing arm assemblies is coordinated with the movement of the first and second swing arms.

56. The exercise device of claim 43 further comprising rigid follower arms extending along oblique axes and pivotally coupled to the first and second footpads, respectively, for pivotal movement about second divergent axes.

* * * * *